US011744296B2

(12) United States Patent
Ademe

(10) Patent No.: US 11,744,296 B2
(45) **Date of Patent: *Sep. 5, 2023**

(54) SMOKING ARTICLE

(71) Applicant: R. J. Reynolds Tobacco Co., Winston-Salem, NC (US)

(72) Inventor: Balager Ademe, Winston-Salem, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 271 days.

This patent is subject to a terminal disclaimer.

(21) Appl. No.: 17/095,306

(22) Filed: Nov. 11, 2020

(65) Prior Publication Data

US 2021/0068469 A1 Mar. 11, 2021

Related U.S. Application Data

(63) Continuation of application No. 16/401,798, filed on May 2, 2019, now Pat. No. 10,874,140, which is a (Continued)

(51) Int. Cl.
*A24F 42/10* (2020.01)
*A24F 42/60* (2020.01)

(52) U.S. Cl.
CPC ..... *A24F 42/10* (2020.01); *A24F 42/60* (2020.01)

(58) Field of Classification Search
CPC ..... A24F 42/10; A24F 42/60
See application file for complete search history.

(56) References Cited

U.S. PATENT DOCUMENTS 1,541,891 A 6/1925 Becker
1,607,132 A 11/1926 Kuno
(Continued)

FOREIGN PATENT DOCUMENTS

CN 1040496 A 3/1990
CN 102159100 A 8/2011
(Continued)

OTHER PUBLICATIONS

"Between" Merriam-Webster.com. Merriam-Webster, n.d. Web Dec. 21, 2017.

(Continued)

*Primary Examiner* — Russell E Sparks
(74) *Attorney, Agent, or Firm* — Womble Bond Dickinson (US) LLP; Chris Humphrey; John V. Forcier

(57) ABSTRACT

A smoking article is provided and has opposed lighting and mouth ends. A mouth end portion is disposed at the mouth end and a heat generation portion is disposed about the lighting end. An outer wrapping material is wrapped at least about the heat generation portion and extends toward the mouth end portion, to define a cylindrical rod. An aerosol-generating portion is disposed within the outer wrapping material and between the heat generation and mouth end portions. The aerosol-generating portion is configured to generate an aerosol in response to heat received from the heat generation portion. Heat from the heat generation portion for aerosol formation is provided by igniting a combustible fuel element (e.g., a plurality of parts or pieces of clean burning carbonaceous material) located within an enclosed heat generation cartridge.

21 Claims, 8 Drawing Sheets

Related U.S. Application Data continuation of application No. 14/964,906, filed on Dec. 10, 2015, now Pat. No. 10,314,334.

(56) References Cited

U.S. PATENT DOCUMENTS

| | | | |
|---|---|---|---|
| 1,941,531 | A | 1/1934 | Blankenship |
| 2,008,433 | A | 7/1935 | Ashour |
| 2,595,572 | A | 5/1952 | Green |
| 2,779,340 | A | 1/1957 | Mansfield |
| 3,308,600 | A | 3/1967 | Otto et al. |
| 4,280,187 | A | 7/1981 | Reuland et al. |
| 4,281,670 | A | 8/1981 | Heitmann et al. |
| 4,708,151 | A | 11/1987 | Shelar |
| 4,714,082 | A | 12/1987 | Banerjee et al. |
| 4,756,318 | A | 7/1988 | Clearman et al. |
| 4,793,365 | A | 12/1988 | Sensabaugh, Jr. et al. |
| 4,807,809 | A | 2/1989 | Pryor et al. |
| 4,819,665 | A | 4/1989 | Roberts et al. |
| 4,850,301 | A | 7/1989 | Greene, Jr. et al. |
| 4,881,556 | A | 11/1989 | Clearman et al. |
| 4,893,637 | A | 1/1990 | Hancock et al. |
| 4,938,238 | A | 7/1990 | Barnes et al. |
| 4,966,171 | A | 10/1990 | Serrano et al. |
| 4,989,619 | A | 2/1991 | Clearman et al. |
| 4,991,606 | A | 2/1991 | Serrano et al. |
| 5,020,548 | A | 6/1991 | Farrier et al. |
| 5,027,836 | A | 7/1991 | Shannon et al. |
| 5,027,837 | A | 7/1991 | Clearman et al. |
| 5,040,552 | A | 8/1991 | Schleich et al. |
| 5,060,676 | A | 10/1991 | Hearn et al. |
| 5,065,776 | A | 11/1991 | Lawson et al. |
| 5,067,499 | A | 11/1991 | Banerjee et al. |
| 5,076,296 | A | 12/1991 | Nystrom et al. |
| 5,076,297 | A | 12/1991 | Farrier et al. |
| 5,099,861 | A | 3/1992 | Clearman et al. |
| 5,105,831 | A | 4/1992 | Banerjee et al. |
| 5,105,838 | A | 4/1992 | White et al. |
| 5,129,409 | A | 7/1992 | White et al. |
| 5,148,821 | A | 9/1992 | Best et al. |
| 5,156,170 | A | 10/1992 | Clearman et al. |
| 5,159,940 | A | 11/1992 | Hayward et al. |
| 5,178,165 | A | 1/1993 | DeFelice |
| 5,178,167 | A | 1/1993 | Riggs et al. |
| 5,183,062 | A | 2/1993 | Clearman et al. |
| 5,211,684 | A | 5/1993 | Shannon et al. |
| 5,240,012 | A | 8/1993 | Ehrman et al. |
| 5,247,947 | A | 9/1993 | Clearman et al. |
| 5,265,626 | A | 11/1993 | Schneider et al. |
| 5,303,720 | A | 4/1994 | Banerjee et al. |
| 5,345,955 | A | 9/1994 | Clearman et al. |
| 5,396,911 | A | 3/1995 | Casey, III et al. |
| 5,469,871 | A | 11/1995 | Barnes et al. |
| 5,546,965 | A | 8/1996 | White |
| 5,551,451 | A | 9/1996 | Riggs et al. |
| 5,560,376 | A | 10/1996 | Meiring et al. |
| 5,592,955 | A | 1/1997 | Keritsis |
| 5,595,577 | A | 1/1997 | Bensalem et al. |
| 5,692,525 | A | 12/1997 | Counts et al. |
| 5,706,834 | A | 1/1998 | Meiring et al. |
| 5,727,571 | A | 3/1998 | Meiring et al. |
| 5,778,899 | A | 7/1998 | Saito et al. |
| 5,845,649 | A | 12/1998 | Saito et al. |
| 5,902,431 | A | 5/1999 | Wilkinson et al. |
| 5,944,025 | A | 8/1999 | Cook et al. |
| 6,006,757 | A | 12/1999 | Lichtenberg |
| 6,053,176 | A | 4/2000 | Adams et al. |
| 6,164,287 | A | 12/2000 | White |
| 6,229,115 | B1 | 5/2001 | Voss et al. |
| 6,311,694 | B1 | 11/2001 | Nichols et al. |
| 6,345,625 | B1 | 2/2002 | Chew |
| 6,371,127 | B1 | 4/2002 | Snaidr et al. |
| 6,532,965 | B1 | 3/2003 | Abhulimen et al. |
| 6,615,843 | B2 | 9/2003 | Pera |
| 6,748,955 | B2 | 6/2004 | Snaidr et al. |
| 7,080,649 | B2 | 7/2006 | Heu |
| 7,296,578 | B2 | 11/2007 | Read, Jr. |
| 7,434,585 | B2 | 10/2008 | Holmes |
| 7,503,330 | B2 | 3/2009 | Borschke et al. |
| 7,600,517 | B1 | 10/2009 | Holzrichter |
| 7,624,739 | B2 | 12/2009 | Snaidr et al. |
| 7,647,932 | B2 | 1/2010 | Cantrell et al. |
| 7,753,056 | B2 | 7/2010 | Borschke et al. |
| 7,836,897 | B2 | 11/2010 | Borschke et al. |
| 8,061,361 | B2 | 11/2011 | Maeder et al. |
| 8,151,803 | B2 | 4/2012 | Inagaki |
| 8,302,611 | B2 | 11/2012 | Rowley |
| 8,424,538 | B2 | 4/2013 | Thomas et al. |
| 8,464,726 | B2 | 6/2013 | Sebastian et al. |
| 8,469,035 | B2 | 6/2013 | Banerjee et al. |
| 8,528,567 | B2 | 9/2013 | Hajaligol |
| 8,616,217 | B2 | 12/2013 | Tsurizumi et al. |
| 8,678,013 | B2 | 3/2014 | Crooks et al. |
| 8,733,345 | B2 | 5/2014 | Siller |
| 8,863,754 | B2 | 10/2014 | Renaud et al. |
| 8,915,255 | B2 | 12/2014 | Poget et al. |
| 9,078,473 | B2 | 7/2015 | Worm et al. |
| 9,149,072 | B2 | 10/2015 | Conner et al. |
| 9,220,301 | B2 | 12/2015 | Banerjee et al. |
| 9,301,546 | B2 | 4/2016 | Thomas et al. |
| 9,332,784 | B2 | 5/2016 | Banerjee et al. |
| 9,439,453 | B2 | 9/2016 | Conner et al. |
| 9,532,591 | B2 | 1/2017 | Mironov |
| 9,549,572 | B2 | 1/2017 | Dincer et al. |
| 9,609,893 | B2 | 4/2017 | Novak, III et al. |
| 9,629,393 | B2 | 4/2017 | Stolz et al. |
| 9,717,273 | B2 | 8/2017 | Poget et al. |
| 9,730,468 | B2 | 8/2017 | Poget et al. |
| 9,801,412 | B2 | 10/2017 | Grant |
| 9,894,930 | B2 | 2/2018 | Bonici et al. |
| 9,918,494 | B2 | 3/2018 | Mironov et al. |
| 9,930,915 | B2 | 4/2018 | Worm et al. |
| 9,943,114 | B2 | 4/2018 | Batista |
| 10,034,493 | B2 | 7/2018 | Akiyama et al. |
| 10,064,430 | B2 * | 9/2018 | Ugurhan ..... A24D 1/14 |
| 10,111,463 | B2 | 10/2018 | Batista |
| 10,159,277 | B2 | 12/2018 | Bonnely |
| 10,212,968 | B2 | 2/2019 | Mironov et al. |
| 10,440,990 | B2 * | 10/2019 | Raether ..... C10L 5/00 |
| 10,874,140 | B2 * | 12/2020 | Ademe ..... A24D 1/22 |
| 2005/0016549 | A1 | 1/2005 | Banerjee et al. |
| 2005/0274390 | A1 | 12/2005 | Banerjee et al. |
| 2006/0169295 | A1 | 8/2006 | Draghetti |
| 2007/0215167 | A1 | 9/2007 | Llewellyn Crooks et al. |
| 2007/0215168 | A1 | 9/2007 | Banerjee et al. |
| 2009/0044818 | A1 | 2/2009 | Takeuchi et al. |
| 2009/0065011 | A1 | 3/2009 | Maeder et al. |
| 2009/0293892 | A1 | 12/2009 | Williams et al. |
| 2010/0258139 | A1 | 10/2010 | Onishi et al. |
| 2011/0083674 | A1 | 4/2011 | Karpinsky |
| 2011/0088707 | A1 | 4/2011 | Hajaligol |
| 2011/0271971 | A1 | 11/2011 | Conner et al. |
| 2012/0042885 | A1 | 2/2012 | Stone et al. |
| 2013/0133675 | A1 | 5/2013 | Shinozaki et al. |
| 2013/0146075 | A1 | 6/2013 | Poget et al. |
| 2013/0167850 | A1 | 7/2013 | Al-Aawar |
| 2013/0228190 | A1 | 9/2013 | Weiss et al. |
| 2013/0233329 | A1 | 9/2013 | Sebastian et al. |
| 2013/0269720 | A1 | 10/2013 | Conner et al. |
| 2014/0048085 | A1 | 2/2014 | Cox |
| 2014/0076337 | A1 | 3/2014 | Woodman et al. |
| 2014/0373859 | A1 | 12/2014 | Raether et al. |
| 2015/0034100 | A1 | 2/2015 | Park et al. |
| 2015/0040924 | A1 | 2/2015 | Mironov et al. |
| 2015/0157052 | A1 | 6/2015 | Ademe et al. |
| 2015/0296882 | A1 | 10/2015 | Mironov et al. |
| 2015/0342254 | A1 | 12/2015 | Mironov et al. |
| 2016/0007648 | A1 | 1/2016 | Sutton et al. |
| 2016/0007649 | A1 | 1/2016 | Sampson et al. |
| 2016/0120216 | A1 | 5/2016 | Mironov et al. |
| 2016/0135495 | A1 | 5/2016 | Poget et al. |
| 2016/0174609 | A1 | 6/2016 | Mironov |
| 2016/0192704 | A1 | 7/2016 | Bonnely |
| 2016/0316816 | A1 | 11/2016 | Lavanchy et al. |
| 2016/0360785 | A1 | 12/2016 | Bless et al. |

(56) References Cited

U.S. PATENT DOCUMENTS

| | | | |
|---|---|---|---|
| 2017/0000189 | A1 | 1/2017 | Mironov et al. |
| 2017/0055577 | A1 | 3/2017 | Batista |
| 2017/0055578 | A1 | 3/2017 | Oda et al. |
| 2017/0164654 | A1 | 6/2017 | Ademe |
| 2017/0196261 | A1 | 7/2017 | Borges De Couraca et al. |
| 2017/0303585 | A1 | 10/2017 | Florack et al. |
| 2017/0318859 | A1 | 11/2017 | Batista |
| 2018/0000165 | A1 | 1/2018 | Liu |
| 2018/0014571 | A1 | 1/2018 | Nakano |
| 2018/0070640 | A1 | 3/2018 | Bessant et al. |
| 2018/0116280 | A1 | 5/2018 | Maiwald et al. |
| 2018/0192707 | A1 | 7/2018 | Worm et al. |
| 2018/0317560 | A1 | 11/2018 | Shinozaki et al. |
| 2018/0325167 | A1 | 11/2018 | Grant |
| 2018/0368468 | A1 | 12/2018 | Mishra et al. |
| 2019/0000135 | A1 | 1/2019 | Lavanant et al. |
| 2019/0000141 | A1 | 1/2019 | Rojo-Calderon et al. |
| 2019/0000142 | A1 | 1/2019 | Lavanchy et al. |
| 2019/0014818 | A1 | 1/2019 | Saygili |
| 2019/0014820 | A1 | 1/2019 | Malgat |
| 2019/0014821 | A1 | 1/2019 | Batista et al. |
| 2019/0059449 | A1 | 2/2019 | Akiyama et al. |
| 2019/0059450 | A1 | 2/2019 | Akiyama et al. |
| 2019/0075848 | A1 | 3/2019 | Worm et al. |

FOREIGN PATENT DOCUMENTS

| | | | |
|---|---|---|---|
| CN | 105124761 | A | 12/2015 |
| EP | 0352105 | A2 | 1/1990 |
| EP | 0352106 | A2 | 1/1990 |
| EP | 1808087 | A1 | 7/2007 |
| EP | 2550879 | A1 | 1/2013 |
| WO | WO-1995034226 | A1 | 12/1995 |
| WO | WO-1998054989 | A1 | 12/1998 |
| WO | WO-2009022232 | A2 | 2/2009 |
| WO | WO-2012164077 | A1 | 12/2012 |
| WO | WO-2013072336 | A1 | 5/2013 |
| WO | WO-2013098380 | A1 | 7/2013 |
| WO | WO-2013098405 | A2 | 7/2013 |
| WO | WO-2013098410 | A2 | 7/2013 |
| WO | WO-2013104914 | A1 | 7/2013 |
| WO | WO-2013120849 | A1 | 8/2013 |
| WO | WO-2013120854 | A1 | 8/2013 |
| WO | WO-2013124357 | A1 | 8/2013 |
| WO | WO-2013149810 | A1 | 10/2013 |
| WO | WO-2013162028 | A1 | 10/2013 |
| WO | WO-2013164077 | A1 | 11/2013 |
| WO | WO-2013189836 | A1 | 12/2013 |
| WO | WO-2014037270 | A1 | 3/2014 |
| WO | WO-2014156838 | A1 | 10/2014 |
| WO | WO-2015022317 | A1 * | 2/2015 ..... A24B 15/165 |
| WO | WO-2015097005 | A1 | 7/2015 |
| WO | WO-2015101595 | A1 | 7/2015 |
| WO | WO-2015128384 | A1 | 9/2015 |
| WO | WO-2015151158 | A1 | 10/2015 |
| WO | WO-2015184744 | A1 | 12/2015 |
| WO | WO-2015197850 | A1 | 12/2015 |
| WO | WO-2017042297 | A1 | 3/2017 |
| WO | WO-2017108912 | A1 | 6/2017 |
| WO | WO-2017114760 | A1 | 7/2017 |
| WO | WO-2017115181 | A1 | 7/2017 |
| WO | WO-2017115182 | A1 | 7/2017 |
| WO | WO-2017115183 | A1 | 7/2017 |
| WO | WO-2017115184 | A1 | 7/2017 |
| WO | WO-2017115185 | A1 | 7/2017 |
| WO | WO-2017115188 | A1 | 7/2017 |
| WO | WO-2017115196 | A1 | 7/2017 |
| WO | WO-2017207442 | A1 | 12/2017 |
| WO | WO-2017212284 | A1 | 12/2017 |
| WO | WO-2018170800 | A1 | 9/2018 |
| WO | WO-2018201655 | A1 | 11/2018 |
| WO | WO-2019010680 | A1 | 1/2019 |

OTHER PUBLICATIONS

"Chemical and Biological Studies on New Cigarette Prototypes That Heat Instead of Burn Tobacco." Winston-Salem, NC: R.J. Reynolds Tobacco Company. (1988): 44-63.

Millette, J., Brown, R., Kyle, J., Turner Jr., W., Hill, W., Boltin, W., Distinguishing Coal, Coke and Other Black Particles, The Microscope, vol. 57:2, pp. 51-57 (Year: 2009).

* cited by examiner

SMOKING ARTICLE

CROSS-REFERENCE TO RELATED APPLICATIONS

This application is a continuation of U.S. application Ser. No. 16/401,798, filed May 2, 2019, which is a continuation of U.S. application Ser. No. 14/964,906, filed Dec. 10, 2015, which applications are is hereby incorporated by reference in their it entireties in this application.

BACKGROUND OF THE DISCLOSURE

Field of the Disclosure

The present disclosure relates to products made or derived from tobacco, or that otherwise incorporate tobacco, and are intended for human consumption; and more particularly, to segmented-type smoking articles that yield aerosols having considerably reduced quantities of incomplete combustion and pyrolysis products relative to tobacco products that produce smoke by burning tobacco.

Disclosure of Related Art

Popular smoking articles, such as cigarettes, have a substantially cylindrical rod-shaped structure and include a charge, roll or column of smokable material, such as shredded tobacco (e.g., in cut filler form), surrounded by a paper wrapper, thereby forming a so-called "smokable rod", "tobacco rod" or "cigarette rod." Normally, a cigarette has a cylindrical filter element aligned in an end-to-end relationship with the tobacco rod. Preferably, a filter element comprises plasticized cellulose acetate tow circumscribed by a paper material known as "plug wrap." Preferably, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999); which is incorporated herein by reference. A traditional type of cigarette is employed by a smoker by lighting one end thereof and burning the tobacco rod. The smoker then receives mainstream smoke into his/her mouth by drawing on the opposite end (e.g., the filter end or mouth end) of the cigarette. Through the years, efforts have been made to improve upon the components, construction and performance of smoking articles. See, for example, the background art discussed in U.S. Pat. No. 7,753,056 to Borschke et al.; which is incorporated herein by reference.

Certain types of cigarettes that employ carbonaceous fuel elements have been commercially marketed under the brand names "PREMIER," "ECLIPSE" and "REVO" by R. J. REYNOLDS TOBACCO COMPANY. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). Additionally, a similar type of cigarette has been marketed in Japan by JAPAN TOBACCO INC. under the brand name "STEAM HOT ONE."

Various types of smoking products incorporating carbonaceous fuel elements for heat generation and aerosol formation recently have been set forth in the patent literature; and several patent documents provide a historical perspective of the technology related to smoking products that deliver aerosols having chemical compositions that are relatively simple compared to that of mainstream smoke produced by burning tobacco. See, for example, the types of smoking products and associated technologies proposed in U.S. Pat. No. 4,793,365 to Sensabaugh et al.; U.S. Pat. No. 5,099,861 to Clearman et al.; U.S. Pat. No. 7,647,932 to Cantrell et al.; U.S. Pat. No. 7,836,897 to Borschke et al.; U.S. Pat. No. 8,469,035 to Banerjee et al.; U.S. Pat. No. 8,464,726 to Sebastian et al.; U.S. Pat. No. 8,616,217 to Tsurizumi et al; U.S. Pat. No. 8,678,013 Crooks, et al. and U.S. Pat. No. 8,915,255 to Poget et al.; US Pat. Pub. Nos. 2012/0042885 to Stone et al.; 2013/0133675 to Shinozaki et al. and 2015/0157052 to Ademe et al.; PCT WO Nos. 2012/0164077 to Gladden et al.; 2013/098380 to Raether et al.; 2013/098405 to Zuber et al.; 2013/098410 to Zuber et al.; 2013/104914 to Woodcock; 2013/120849 to Roudier et al.; 2013/120854 to Mironov; 2013/162028 to Azegami et al. and 20132/1600112 to Saleem et al.; EP 1808087 to Baba et al.; EP 2550879 to Tsuruizumi et al. and U.S. patent application Ser. No. 14/840,178, filed Aug. 31, 2015 to Beeson et al.; which are incorporated herein by reference.

It would be highly desirable to provide smoking articles that demonstrate the ability to provide to a smoker much of the enjoyment of conventional cigarette smoking, without delivering aerosol that incorporates considerable quantities of incomplete combustion and pyrolysis products generated as a result of burning tobacco.

BRIEF SUMMARY OF THE DISCLOSURE

The above and other needs are met by aspects of the present disclosure which, in one aspect, provides an elongate smoking article having a lighting end and an opposed mouth end. Such a smoking article comprises a mouth end portion disposed about the mouth end, and a heat generation portion disposed about the lighting end. An outer wrapping material is wrapped at least about the heat generation portion and extends toward the mouth end portion, so as to define a cylindrical rod. An aerosol-generating portion is disposed within the outer wrapping material, between the heat generation portion and the mouth end portion, wherein the aerosol-generating portion is configured to generate an aerosol in response to heat received from the heat generation portion. A heat generation cartridge is disposed within the heat generation portion and is at least partially exposed at the lighting end, wherein the heat generation cartridge is configured to include opposed perforated end portions and an ignitable fuel element between the end portions, such that the fuel element is capable of emitting heat upon ignition thereof.

Another aspect of the present disclosure provides a method of forming an elongate smoking article, the smoking article having a lighting end and an opposed mouth end. Such a method comprises wrapping an outer wrapping material at least about a heat generation portion disposed about the lighting end, such that the outer wrapping material extends toward a mouth end portion disposed about the mouth end, and so as to define a cylindrical rod. An aerosol-generating portion is disposed within the outer wrapping material, between the heat generation portion and the mouth end portion, wherein the aerosol-generating portion is configured to generate an aerosol in response to heat received from the heat generation portion. A heat generation cartridge is disposed within the heat generation portion such that the heat generation cartridge is at least partially exposed at the lighting end, wherein the heat generation cartridge is configured to include opposed perforated end portions and an ignitable fuel element between the end portions, and wherein the fuel element is capable of emitting heat upon ignition thereof.

Aspects of the present disclosure are directed to a generally elongate type of smoking article having a lighting end (i.e., upstream end) and an opposed mouth end portion (i.e., downstream end). That smoking article comprises a heat generation portion disposed at the lighting end. An aerosol-generating portion is disposed between the heat generation portion and the mouth end portion, and the aerosol-generating portion is configured to generate an aerosol in response to heat transferred thereto from the heat generation portion during use. Additionally, the heat generation portion may include or have the form of a cartridge (e.g., a generally cylindrical container having perforated regions to allow for airflow therethrough) that incorporates a combustible component (e.g., a fuel element comprising parts or pieces of combustible carbonaceous material). For example, a sealed hollow cylindrical cartridge (e.g., constructed from a not highly heat-conductive material such as carbon, glass, or ceramic) may have perforated regions or components at both upstream and downstream ends. That cartridge may also contain a plurality of parts or pieces (e.g., granules or beads) therein, with the parts or pieces being comprised of a combustible carbonaceous material.

In certain aspects, the present disclosure provides a smoking article having a rod-shaped structure, such as that of a cigarette. The smoking article includes a lighting end and a mouth end. The smoking article also includes an aerosol-generating system that comprises: (i) a heat generation region, portion, or segment, and (ii) an aerosol-generating region, portion, or segment located downstream from the heat generation segment. The heat generation segment and aerosol-generating segment are preferably in a heat exchange relationship with one another. The heat generation segment incorporates a relatively short longitudinally-extending heat source that can be constructed in the format and configurations of a cartridge or container (e.g., a generally cylindrical cartridge constructed from a not highly heat-conductive material such as carbon, glass, ceramic, or other suitable material) possessing opposing regions configured to allow ingress and egress of atmospheric air for passage of the air therethrough) that contains a combustible component or fuel element (e.g., a plurality of parts or pieces, granules, or beads comprised of a carbonaceous material). The aerosol-generating segment most preferably includes a substrate region in which a substrate material (i.e., an aerosol precursor element or aerosol-generating element) is located. A highly preferred substrate incorporates processed tobacco that acts as a carrier for aerosol-forming materials (e.g., glycerin and/or propylene glycol), as well as a source of flavorful components characteristic of tobacco. In certain embodiments, the substrate region incorporates pellets or beads formed from tobacco that are disposed within a substrate cavity. In certain other embodiments, the substrate region incorporates reconstituted tobacco material (e.g., a shredded cast cut filler-type material). The substrate cavity or substrate region where the substrate material is located preferably is circumscribed along the longitudinally extending length of the smoking article by a heat conducting laminate of metal foil and paper. Alternatively, the substrate can be incorporated into a cartridge or container similar in many regards to that cartridge employed for the construction of the heat generation segment. Typically, an outer wrapping material is wrapped about at least a portion of the heat generation portion, and outer wrapping material may also extend over the aerosol-generating region toward the mouth end portion, so as to define a wrapped cylindrical rod. A mouth-end piece, such as a filter element segment, is located at the extreme mouth end of the smoking article.

Aerosol that is produced by a smoking article according to aspects of the present disclosure is generated as a result of the action of heat, produced by ignition/burning of the combustible component(s) of the heat generation segment, upon aerosol forming materials located in the aerosol-generating segment, wherein that aerosol is inhaled by the smoker of that smoking article through the mouth-end piece. Such an aerosol may comprise air-containing components such as vapors, gases, suspended particulates, and the like; in a form suitable for human inhalation, whether or not visible, and whether or not of a form that might be considered to be smoke-like. Most preferably, aerosol components are generated as a result of the action of the heat generated by the heat generation segment upon an aerosol-generating segment (e.g., to vaporize an aerosol-forming material located in the aerosol-generating segment). That heat may be generated by combustion of a combustible component or fuel element that may be considered to be clean burning in nature (e.g., a preferred combustible component is a carbonaceous material, and the aerosol resulting upon use of the cigarette disclosed herein possesses low or extremely low levels of incomplete combustion products and products of pyrolysis, as compared to a cigarette that generates aerosol as a result of the burning of tobacco cut filler). In certain aspects, some flavorful aerosol components also can be generated by burning tobacco of some form, by thermally decomposing some tobacco caused by heating the tobacco or by charring the tobacco (or otherwise causing the tobacco to undergo some form of smolder). As result, the aerosol so formed can contain volatilized components, combustion products (e.g., carbon dioxide and water), as well as some (though most preferably minimal) incomplete combustion products and products of pyrolysis.

Further features and advantages of the present disclosure are set forth in more detail in the following description.

BRIEF DESCRIPTION OF THE DRAWINGS

Figure 12:
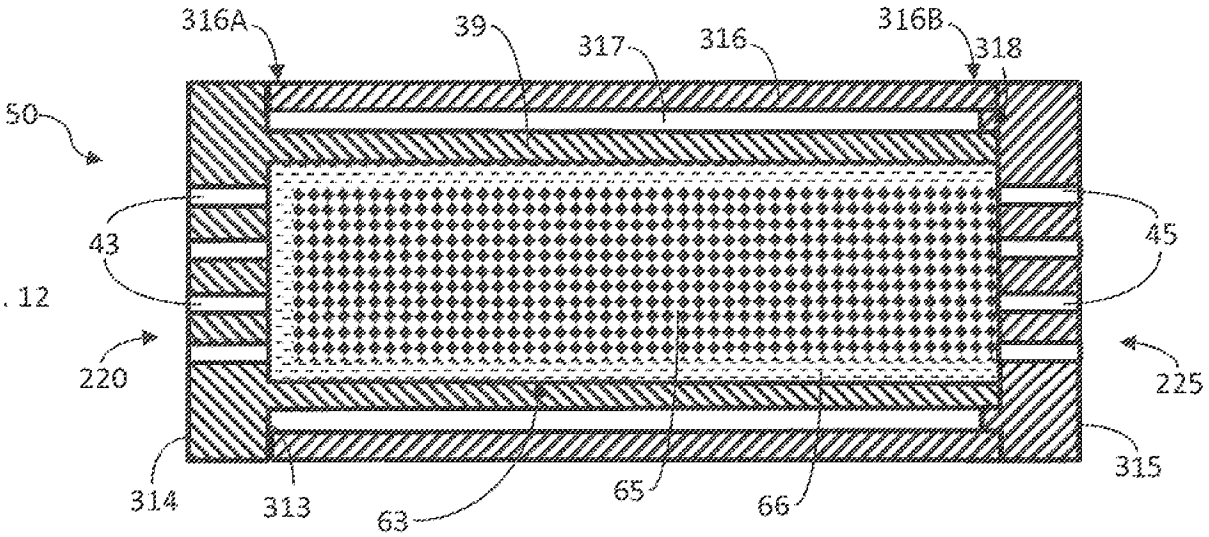
Figure 13:
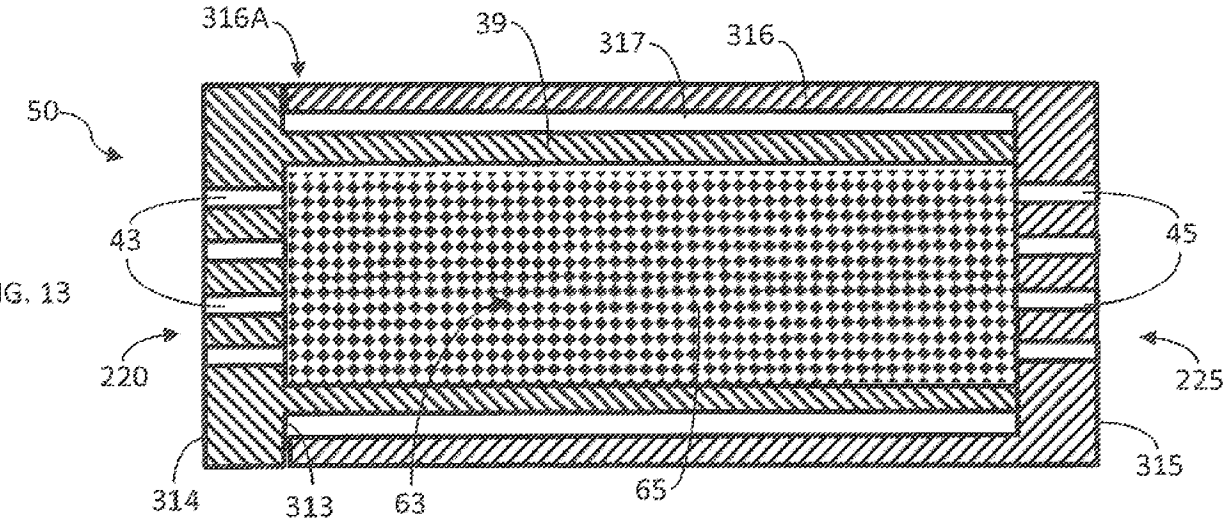
Figure 14:
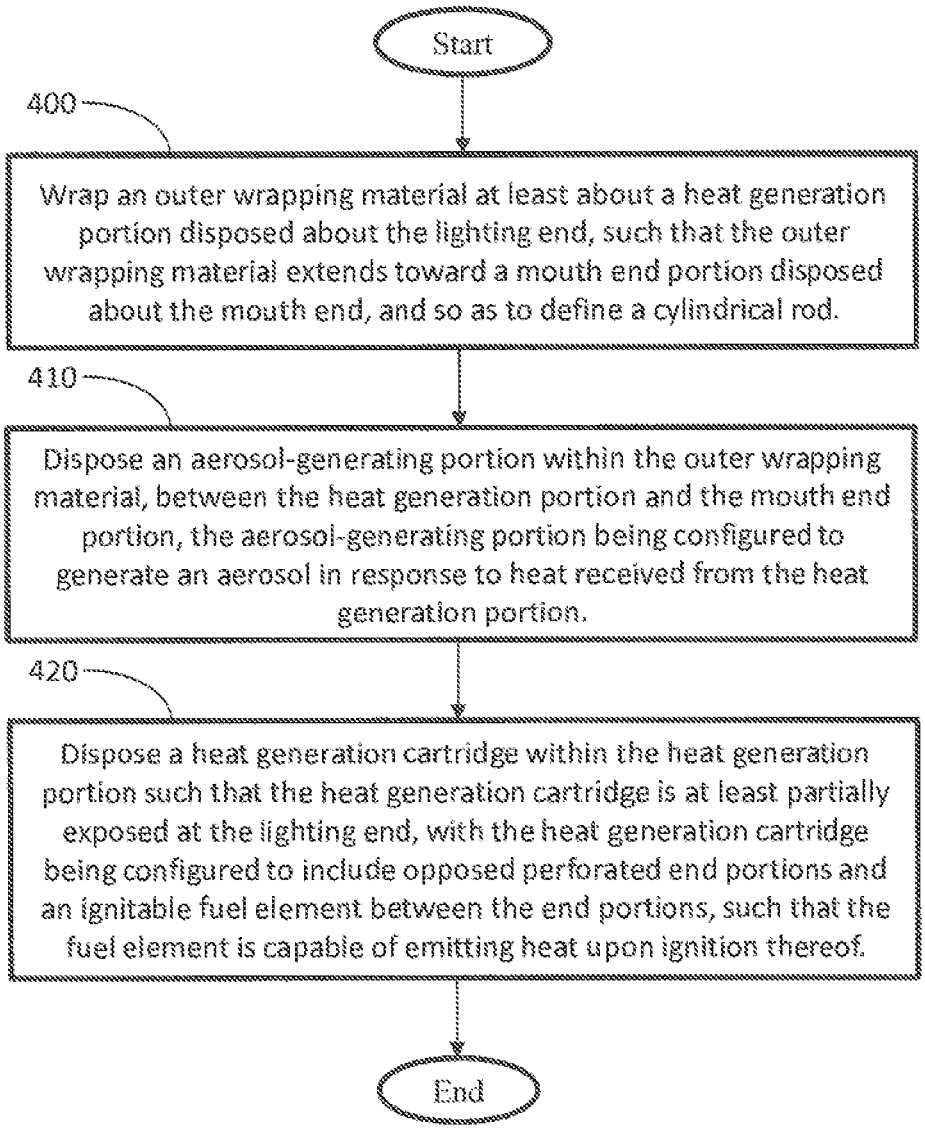

Having thus described the disclosure in general terms, reference will now be made to the accompanying drawings, which are not necessarily drawn to scale, and wherein:

FIGS. 1-3, 6, and 11 each schematically illustrate a longitudinal cross-sectional view of a representative, generally rod-shaped smoking article, according to various aspects of the present disclosure;

FIGS. 4, 5, 7-10, 12, and 13 each schematically illustrate a longitudinal cross-sectional view of a representative heat generation and/or aerosol generation cartridge that may be implemented in a smoking article as shown in any of FIGS. 1-3, 6, and 11, according to various aspects of the present disclosure; and FIG. 14 schematically illustrates a method of forming an elongate smoking article, according to one aspect of the present disclosure.

DETAILED DESCRIPTION OF THE PREFERRED EMBODIMENTS

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will satisfy applicable legal requirements. Like numbers refer to like elements throughout.

Figure 1:
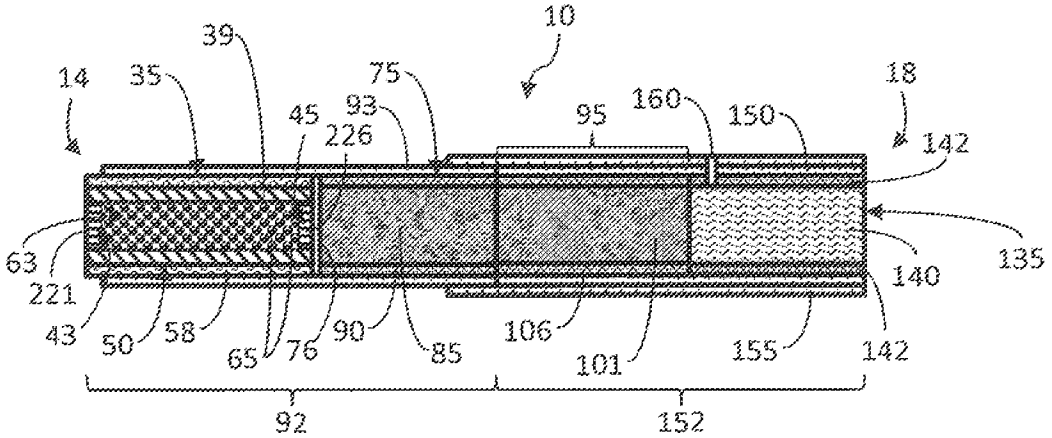

FIG. 1 illustrates a representative smoking article 10 in the form of a cigarette having a lighting end 14 and a mouth end 18. Preferably, the smoking article 10 has the overall size, shape and general appearance of a traditional type of filtered cigarette. At the lighting end 14 is positioned a longitudinally-extending heat generation segment 35. The heat generation segment 35 possesses a longitudinally-extending generally tubular portion 39, which may comprise or otherwise be configured as a heat generation cartridge 50. That segment 35 additionally includes an extreme upstream end or front face 220 that defines a plurality of small perforations 43 to allow for the passage of atmospheric air into the smoking article 10; and that segment further includes a downstream end or back face 225 that also defines a plurality of small perforations 45 to allow for the passage of atmospheric air towards the downstream or mouth end 18 of the smoking article 10. In some aspects, longitudinally-extending generally tubular portion 39 of the heat generation segment 35, in cooperation with the front face 220 and the back face 225, may thus collectively have the general form of a cartridge 50 (i.e., a sealed cartridge in some instances) that acts as container, and that also defines openings pores 43, 45 configured to permit adequate passage of atmospheric air therethrough. In some aspects, the tubular portion 39 may also define one or more pores or perforations, as necessary or desired.

Components used to form the cartridge 50 can vary. The cartridge components (or some of those components) exhibit or can cooperate to exhibit certain heat conductive properties. Exemplary materials used to construct at least a portion of the cartridge 50 may include heat conductive materials such as metallic materials (e.g., aluminum, stainless steel, or the like), though those conductive materials may preferably be wrapped or coated with an insulating material. The cartridge components (or some of those components) alternatively, though most preferably, can be comprised of a material that exhibits properties of a thermal insulator or properties that are considered to be not highly heat conductive. Exemplary materials may include graphite, carbon fiber-reinforced carbon, ceramic, fibrous refractory composite insulation, glass, aluminum oxide, or silicon dioxide, and/or a ceramic coated structure (i.e., ceramic-coated glass or metal). In other aspects, the cartridge components may be coated with an insulating material, such as an insulating paint, graphene, or a high-temperature paint with glass or ceramic particles. Typically, the cartridge 50 is configured to maintain its general shape and overall physical properties during conditions of normal use, and during conditions of normal use, the cartridge 50 is preferably configured to not be combusted, burned or otherwise thermally decomposed to any significant degree that would result in loss of structure or initial structural characteristics.

The overall shape of the cartridge 50 can vary. Preferably, the cartridge 50 is generally cylindrical in shape. In such an aspect, the outer surface of the longitudinally extending tubular portion 39 of the cartridge 50 acts to cooperate in providing structure for the general rod-shaped structure of the smoking article 10; and additionally, the inner surface of the longitudinally extending portion acts as defining the inner confines of the cartridge. In some instances, the outer surface of the longitudinally-extending tubular portion 39 may be appropriately configured such that the cartridge 50 has a fluted configuration extending longitudinally therealong. That is, in various aspects, the cartridge 50 may be configured as a right cylinder or a fluted cylinder, having a longitudinally-extending side wall and the opposed end portions. For the embodiment shown, the longitudinally extending surface or side wall of the tubular portion 39 may be substantially impermeable to the passage of atmospheric air therethrough.

Typically, a cylindrical cartridge 50 is provided by capping each of the perforated upstream and downstream ends of longitudinally extending tubular portion 39 with suitably adapted end caps, or other suitable sealing mechanism. Most preferably, the end caps are permeable to atmospheric air, such that air can pass through the upstream end cap, pass through the inner confines of the tubular section, and exit the downstream end cap. As such, each end cap can be constructed using a screen-like material or configured so as to possess a series of perforations 43, 45 to allow for the passage of air therethrough. As a result, the combination of the tubular section sealed at each end using the respective end caps thereby provides a cylindrically shaped cartridge that acts as an effective receptacle, enclosure or container. In some aspects, the end caps, end walls, or any other structures extending transversely to the longitudinal axis of the cartridge 50 may be comprised of the same materials as the remainder of the cartridge 50 (i.e., the side wall). However, in other instances, it may be preferable for the end caps, end walls, or any other structures extending transversely to the longitudinal axis of the cartridge 50 to be comprised of a heat conductive material so as to facilitate and promote the passage of heated air through the cartridge 50. Accordingly, such a cartridge 50 may be comprised of the end caps, end walls, or any other structures extending transversely to the longitudinal axis of the cartridge 50, formed of a heat conductive material, while the side wall or cylindrical body of the cartridge 50 may be formed of a material exhibiting thermal insulation properties.

Optionally, the outer surface of the length (or portion of the length) of the longitudinally extending tubular portion 39 of the sealed cartridge 50 can be surrounded, wrapped or over coated with a material that exhibits properties of a thermal insulator 58. That is, in particular aspects, an insulation element 58 may be wrapped about the heat generation cartridge 50, with the insulation element 58 extending longitudinally along the heat generation cartridge 50 from the lighting end 14 toward the aerosol-generating portion 75. In some aspects, the insulating element 58 may extend longitudinally from the heat generation segment 35 over a portion of or over the entire length of the aerosol-generating portion, as necessary or desired. Such an insulating element 58 may comprise, for instance, a glass fiber mat, an insulating coating, an insulating paint, a glass sleeve, or a ceramic sleeve. Other examples of types of insulation materials, representative insulation assemblies and manners and methods for producing insulation assemblies for smoking article components are set forth in U.S. Pat. No. 4,807,809 to Pryor et al.; U.S. Pat. No. 4,893,637 to Hancock et al.; U.S. Pat. No. 4,938,238 to Barnes et al.; U.S. Pat. No. 5,027,836 to Shannon et al.; U.S. Pat. No. 5,065,776 to Lawson et al.; U.S. Pat. No. 5,105,838 to White et al.; U.S. Pat. No. 5,119,837 to Banerjee et al.; U.S. Pat. No. 5,247,947 to Clearman et al.; U.S. Pat. No. 5,303,720 to Banerjee et al.; U.S. Pat. No. 5,345,955 to Clearman et al.; U.S. Pat. No. 5,396,911 to Casey, III et al.; U.S. Pat. No. 5,546,965 to White; U.S. Pat. No. 5,727,571 to Meiring et al.; U.S. Pat. No. 5,902,431 to Wilkinson et al.; U.S. Pat. No. 5,944,025 to Cook et al.; U.S. Pat. No. 8,424,538 to Thomas et al.; U.S. Pat. No. 8,464,726 to Sebastian et al. and U.S. Pat. No. 8,678,013 Crooks et al.; and U.S. patent application Ser. No.

14/840,178, filed Aug. 31, 2015 to Beeson et al.; which are incorporated herein by reference.

The heat generation segment 35 may incorporate a combustible component 63 (i.e., an ignitable fuel element) that burns to generate heat for use in the production of aerosol via the aerosol-generating portion 75. In some aspects, the combustible component 63 is contained or enclosed within the cartridge 50. In other aspects, the combustible component 63 may be coated on, be formed as a portion of, or otherwise associated with the cartridge 50. That is, in some instances, the ignitable fuel element/combustible component 63 may comprises a coating applied to an interior surface of the heat generation cartridge 50 or an object, or parts or pieces thereof, disposed within the heat generation cartridge 50.

The form of the combustible component 63 can vary. The combustible component 63 contained within the cartridge 50 can be constructed as a unitary member. That representative one piece combustible component 63 may have a generally cylindrical shape, and is preferably configured so as to be contained or positioned within, and maintained or secured in position within, the generally cylindrical compartment defined by the heat source cartridge 50. Typically, the one piece combustible component 63 can possess longitudinally extending grooves in its longitudinally-extending outer surface; and that combustible component 63 also can define longitudinally-extending air passageways therethrough. See, for example, the types of configurations for those representative extruded carbonaceous heat sources that are set forth in U.S. Pat. No. 4,989,619 to Clearman et al. and U.S. Pat. No. 8,469,035 to Banerjee et al.; and U.S. Pat. Pub. No. 2015/0083150 to Conner et al.; which are incorporated herein by reference.

Alternatively, and preferably, the combustible component 63 can be constructed from, and employed as, at least two parts or pieces. For example, and in certain preferred aspects, that combustible component 63 has the form of a plurality of, or a collection of a plurality of, parts or pieces 65. Such parts or pieces typically are relatively small in size, and can have the form of flakes, spheres, cylinders, tubes, rings, cubes, shredded pieces of sheet-like material, helical strands, long string-like or tape-like strands, irregular pieces produced by crushing large pieces of material, or the like. Those parts or pieces also can be granular in nature. In certain embodiments, all of the parts or pieces of the combustible component 63 can be of the same general size and shape (e.g., all of the parts or pieces within the cartridge 50 can be comprised of spherical beads of essentially identical size, or all of the parts or pieces can have the form of granules of comparable size). In certain embodiments, the parts or pieces of the combustible component 63 can be different in sizes and shapes (e.g., the parts or pieces 65 within the cartridge 50 can be comprised of spherical beads of varying sizes, or the parts or pieces 65 can have the form of a mixture of spherical beads and granules). Preferably, the parts or pieces 65 are of a large enough size, and the perforations 43, 45 at each end of the cartridge 50 are sufficiently small, so that the parts and pieces 65 of the combustible component 63 are maintained within the cartridge 50.

In some instances, the cartridge 50 may include only a limited amount of the parts or pieces, and the reminder of the space therein may remain empty (air space) or may be filled with a filler material (i.e., to hold the beads/granules in place within the cartridge 50). In some instances, the air space defined by the parts or pieces 65 occupying the compartment defined by the cartridge 50 may, for example, serve to increase the surface area of the parts or pieces 65 of the combustible component 63 that is available for combustion and/or may facilitate ignition of those parts or pieces 65. In some aspects, the compartment of the cartridge 50 receiving the parts or pieces 65 therein may be filled with the parts or pieces such that there remains greater than about 5% air space (i.e., for a more granular material), in some instances greater than about 10% air space, and in other instances up to about 30% or 40% air space (i.e., for relatively larger parts or pieces). The number of parts or pieces included within the compartment may vary. The amount of parts or pieces may generally be greater than 25, typically greater than 50, and preferably greater than 100; though the amount of parts or pieces typically does not exceed 1000. For example, relatively larger parts or pieces may result in about 100 to about 150 parts or pieces within the compartment of the cartridge 50. In instances of a more granular material, the compartment may receive about 600 to about 800 parts or pieces. In any event, one skilled in the art will appreciate that a cartridge 50 receiving such parts or pieces 65 of the combustible component 63 will have sufficient continuity of the air space therein so as to provide one or more pathways for the air drawn through the cartridge 50 in response to draw imparted by the user of the smoking article 10.

Most preferably, the combustible component 63 is comprised of, or incorporates, a clean burning combustible material; and such a material typically can be provided by selecting a suitable carbonaceous material. Such combustible carbonaceous materials generally have high carbon content. Preferred carbonaceous materials are comprised predominantly of carbon, typically have carbon contents of greater than about 60 percent, generally greater than about 70 percent, often greater than about 80 percent, and frequently greater than about 90 percent, on a dry weight basis. The combustible component 63 also can incorporate components or elements other than combustible carbonaceous materials (e.g., tobacco components, such as powdered tobaccos or tobacco extracts; flavoring agents; salts, such as sodium chloride, potassium chloride and sodium carbonate; heat stable graphite fibers; iron oxide powder; glass filaments; powdered calcium carbonate; alumina granules; ammonia sources, such as ammonia salts; and/or binding agents, such as guar gum, ammonium alginate and sodium alginate).

A suitable combustible component 63 can be provided using those types of fuel element formulations that have been incorporated within those cigarettes commercially marketed under the trade names "Premier," "Eclipse," "Revo" and "Steam Hot One." Additionally, representative types of combustible component ingredients and formulations are set forth in U.S. Pat. No. 4,219,031 to Rainer et al.; U.S. Pat. No. 4,714,082 to Banerjee et al.; U.S. Pat. No. 4,756,318 to Clearman et al.; U.S. Pat. No. 4,819,665 to Roberts et al.; U.S. Pat. No. 4,881,556 to Clearman et al.; U.S. Pat. No. 4,920,990 to Lawrence et al.; U.S. Pat. No. 4,989,619 to Clearman et al.; U.S. Pat. No. 5,007,440 to Robinson et al.; U.S. Pat. No. 5,020,548 to Farrier et al.; U.S. Pat. No. 5,027,837 to Clearman et al.; U.S. Pat. No. 5,060,673 to Lehman; U.S. Pat. No. 5,067,499 to Banerjee et al.; U.S. Pat. No. 5,076,297 to Farrier et al.; U.S. Pat. No. 5,099,861 to Clearman et al.; U.S. Pat. No. 5,105,831 to Banerjee et al.; U.S. Pat. No. 5,129,409 to White et al.; U.S. Pat. No. 5,148,821 to Best et al.; U.S. Pat. No. 5,156,170 to Clearman et al.; U.S. Pat. No. 5,178,167 to Riggs et al.; U.S. Pat. No. 5,211,684 to Shannon et al.; U.S. Pat. No. 5,247,947 to Clearman et al.; U.S. Pat. No. 5,345,955 to Clearman et al.; U.S. Pat. No. 5,461,879 to Bolton et al.; U.S. Pat. No.

5,469,871 to Barnes et al.; U.S. Pat. No. 5,551,451 to Riggs; U.S. Pat. No. 5,560,376 to Meiring et al.; U.S. Pat. No. 5,706,834 to Meiring et al.; U.S. Pat. No. 5,727,571 to Meiring et al.; U.S. Pat. No. 7,836,897 to Borschke et al.; U.S. Pat. No. 8,119,555 to Banerjee et al.; U.S. Pat. No. 8,617,263 to Banerjee et al. and U.S. Pat. No. 8,678,013 to Crooks; U.S. Pat. App. Pub. Nos. 2005/0274390 to Banerjee et al.; 2007/0215168 to Banerjee et al.; 2009/0044818 to Takeuchi et al.; 2012/0042885 to Stone et al.; 2013/0269720 to Stone et al.; and 2015/0083150 to Conner et al.; and U.S. patent application Ser. No. 14/755,205, filed Jun. 30, 2015 to Nordskog et al. and Ser. No. 14/840,178, filed Aug. 31, 2015 to Beeson et al.; which are incorporated herein by reference.

Optionally, the parts or pieces 65 of the combustible component 63 can be treated with a sticky substance, such as a syrup, a binder, an adhesive material, or the like. As such, the various parts and pieces 65 may be treated so as to provide an agglomerate or cohesive combustible component 63, for example, to minimize effects of movement of individual parts or pieces 65, or distortion or separation of the combustible component 63 that would hinder insertion thereof into the cartridge 50, etc.; and hence there is provided a manner or method for maintaining the general physical integrity of those parts or pieces 65 comprising the combustible component 63.

In other aspects, the combustible component 63 may have the form of plurality of irregularly-shaped granular parts or pieces 65, wherein those pieces 65 are sized and numbered so as to substantially fill the hollow internal region of the generally cylindrical heat source cartridge 50. The random nature of the positioning of those pieces 65 may result in voids or spaces between those pieces 65. Typically, the granules of combustible component are comprised of a clean-burning carbonaceous material; however, other combustible materials (e.g., parts or pieces of tobacco material) also can be combined with the carbonaceous material to provide small amounts of flavored smoke. Optionally, the combustible granules can be mixed with non-combustible materials (e.g., glass beads) that provide for physical separation of the various combustible granules.

Positioned downstream from the heat generation segment 35 (i.e., toward the mouth end 18), and in a heat transfer relationship therewith (for example, by heat conduction), is an aerosol-generating segment 75. In particular aspects, the heat generation segment 35 is axially aligned in an end-to-end serial relationship with an aerosol-generating segment 75. Preferably, those segments are in physical contact with one another (i.e., the downstream end of the heat generation segment 35 abuts the upstream end of the aerosol-generating segment 75). Preferably, the general cross-sectional shapes and dimensions of those segments 35, 75 are essentially identical to one another when viewed transversely to the longitudinal axis of the smoking article 10. The physical arrangement of those segments 35, 75 preferably is such that heat is transferred (e.g., by mechanisms that includes conductive and convective heat transfer) from the heat generation segment 35 to the adjacent aerosol-generating segment 75 throughout the time that the combustible component 63 is burned during use.

The aerosol-generating segment 75 includes a substrate material 85 that is itself an aerosol-forming agent or aerosol-forming substance and/or otherwise acts as a carrier for an aerosol-forming agent or material. For example, the aerosol-generating segment 75 can include a reconstituted tobacco material that possesses, incorporates or carries processing aids, flavoring agents and/or an aerosol-forming material or aerosol precursor (e.g., glycerin and/or propylene glycol). The foregoing components of the aerosol-generating segment 75 can be disposed within, and circumscribed by, a wrapping material 90, such as is provided by laminated sheet of paper and aluminum foil. The wrapping material 90 can be configured to facilitate the transfer of heat from the lighting end 14 of the smoking article 10 (e.g., from the heat generation segment 35) to the aerosol-generating segment 75 or component(s) thereof. Thus, heat generated by the heat generation segment 35 is supplied and transferred to the aerosol-generating segment 75 to volatilize the aerosol-forming material associated with the substrate material 85, thus resulting in aerosol formation or generation. Both of the upstream and downstream ends of the aerosol-generating segment 75 are open such that the substrate material 85 contained therein is exposed at both longitudinal ends. As such, heat from the heat generation segment 35 may directly engage the substrate material 85 included in the aerosol-generating segment 75.

Optionally, the heat generation segment 35 and the aerosol-generating segment 75 can have or define a buffer region or spacer segment 76 therebetween. That is, those segments 35, 75 may be optional positioned in a longitudinally spaced-apart relationship with respect to each other. As such, rather than being positioned in an abutting end-to-end relationship, those segments 35, 75 can be arranged to form of an empty air space, or a region partially or substantially completely filled with a non-combustible material (e.g., a heat conductive and air permeable material produced from a material such as a metal, ceramic material, or a combination thereof). For example, the buffer region 76 can incorporate catalytic materials, such as materials incorporating cerium or copper ions or oxides and/or salts of cerium and copper ions. See, for example, U.S. Pat. No. 8,469,035 to Banerjee et al. and U.S. Pat. No. 8,617,263 to Banerjee et al.; and U. S. Pat. Appl. Pub. Nos. 2007/0215168 to Banerjee et al.; which are incorporated herein by reference. When present, a representative buffer region can extend from about 1 mm to about 10 mm along the length of the smoking article 10, but often that length is about 2 mm to about 5 mm between the heat generation segment 35 and the aerosol-generating segment 75.

Components of the aerosol-generating segment 75 can vary. That segment 75 incorporates components or elements that can be vaporized, aerosolized or entrained in air drawn through the smoking article 10 during use. Most preferably, those components, separately or in combination, provide sensory and organoleptic effects (e.g., aroma, flavor, mouth feel, visible aerosol sensations, and the like). Examples of components or elements of the aerosol-generating segment 75 that are drawn into the mouth of the smoker during draw on the mouth end 18 include water (e.g., as water vapor), visible aerosol forming materials (e.g., glycerin and/or propylene glycol), various volatile flavors (e.g., vanillin, menthol, and the like), volatile components of tobacco (e.g., nicotine), and the like.

A preferred aerosol-forming material produces a visible aerosol upon the application of sufficient heat thereto, or otherwise through the action of aerosol forming conditions brought about by components of the smoking article 10. A highly preferred aerosol-forming material produces a visible aerosol that can be considered to be "smoke-like." A preferred aerosol-forming material is chemically simple, relative to the chemical nature of the smoke produced by burning tobacco. A preferred visible aerosol-forming material is a polyol, and exemplary preferred aerosol forming materials include glycerin, propylene glycol, and mixtures thereof. If desired, aerosol forming materials can be combined with other liquid materials, such as water. For example, aerosol forming material formulations can incorporate mixtures of glycerin and water, or mixtures of propylene glycol and water. See, for example, the various aerosol forming materials referenced in U.S. Pat. No. 4,793,365 to Sensabaugh, Jr. et al.; U.S. Pat. No. 5,101,839 to Jakob et al. and U.S. Pat. No. 8,678,013 Crooks, et al.; as well as PCT WO 98/57556 to Biggs et al.; which are incorporated herein by reference.

The substrate material 85 of the aerosol-generating segment 75 can vary. Suitable substrate materials, and associated aerosol-forming materials and additives carried by those substrate materials, have been incorporated within those types of cigarettes commercially marketed under the trade names "Premier," "Eclipse," "Revo" and "Steam Hot One." The substrate material 85 can incorporate tobacco of some form, can be comprised primarily of tobacco or can be provided by virtually all tobacco material. For example, in some embodiments, at least a portion of the overall substrate material is employed in an essentially traditional filler form (e.g., as cut filler). However, suitable substrate materials, and substrate formulations incorporating aerosol-forming materials (including cast sheet and paper-type reconstituted tobacco materials), also are set forth in U.S. Pat. No. 4,793,365 to Sensabaugh et al.; U.S. Pat. No. 4,893,639 to White; U.S. Pat. No. 5,099,861 to Clearman et al.; U.S. Pat. No. 5,101,839 to Jakob et al.; U.S. Pat. No. 5,105,836 to Gentry et al.; U.S. Pat. No. 5,109,122 to Clearman et al.; U.S. Pat. No. 5,159,942 to Brinkley et al.; U.S. Pat. No. 5,203,355 to Clearman et al.; U.S. Pat. No. 5,271,419 to Arzonico et al.; U.S. Pat. No. 5,327,917 to Lekwauwa et al.; U.S. Pat. No. 5,396,911 to Casey, III et al.; U.S. Pat. No. 5,533,530 to Young et al.; U.S. Pat. No. 5,588,446 to Clearman; U.S. Pat. No. 5,598,868 to Jakob et al.; U.S. Pat. No. 5,715,844 to Young et al.; U.S. Pat. No. 6,378,528 to Beeson et al. and U.S. Pat. No. 8,678,013 Crooks, et al.; and U.S. Pat. App. Pub. Nos. 2005/0066986 to Nestor et al.; US 2012/0067360 to Conner et al.; and 2015/0157052 to Ademe et al.; which are incorporated herein by reference. Additionally, substrate materials can have the types of forms or configurations set forth in U.S. Pat. No. 8,839,799 to Conner et al.; as a gathered web or sheet, using the types of techniques generally set forth in U.S. Pat. No. 4,807,809 to Pryor et al., or in the form of a web or sheet that is shredded into a plurality of longitudinally extending strands, using the types of techniques generally set forth in U.S. Pat. No. 5,025,814 to Raker; each of which is incorporated herein by reference.

The manner by which the heat generation segment 35 and the aerosol-generating segment 75 are maintained in place relative to one another along the smoking article 10 can vary. Typically, those segments 35, 75 are secured in place through use of a longitudinally extending paper wrap 93 that overwraps the longitudinally extending surfaces of those segments 35, 75. As such, by combining those segments 35, 75 there is provided an aerosol generating system 92.

Positioned downstream from the aerosol-generating segment 75 (i.e., toward the mouth end 18) may be a tobacco roll segment 95. The tobacco roll segment 95 may be comprised of pieces of tobacco cut filler 101 overwrapped longitudinally with paper 106. Both of the upstream and downstream ends of the tobacco roll segment 95 are open such that the tobacco cut filler 101 contained therein is exposed at both longitudinal ends. The aerosol-generating segment 75 is axially aligned in a longitudinal end-to-end serial relationship with the tobacco roll segment 95. Preferably, those segments 75, 95 are in physical contact with one another (i.e., the downstream end of the aerosol-generating segment 75 abuts the upstream end of the tobacco roll segment 95). The physical arrangement of these segments 75. 95 preferably is such that aerosol exiting the aerosol-generating segment 75 is flavored with a tobacco flavor supplied by the tobacco cut filler 101 as that aerosol passes through the tobacco roll segment 95.

Various combinations and varieties of flavoring agents (including various materials that alter the sensory and/or organoleptic character or nature of mainstream aerosol of a smoking article 10) can be incorporated within the smoking article 10. For example, the substrate material 85 and various other tobacco or other components of the smoking article 10 (e.g., those components that are optionally located within the heat generation segment 35, as well as those within the tobacco roll segment 95) can be treated with tobacco additives of the type that are traditionally used for the manufacture of cigarettes, such as casing and/or top dressing components. See, for example, the types of components set forth in U.S. Pat. No. 8,678,013 Crooks, et al.; which is incorporated herein by reference.

The smoking article 10 preferably includes a suitable mouthpiece, such as a filter element segment 135. The filter element segment 135 is positioned at the extreme mouth end 18 of the smoking article 10; and is positioned at the downstream end of the tobacco roll 95, such that those segments 95, 135 are axially aligned in a longitudinal end-to-end serial relationship, abutting one another, and without any barrier or space therebetween. Preferably, the general cross-sectional shapes and dimensions of those segments 95, 135 are essentially identical to one another when viewed transversely to the longitudinal axis of the smoking article 10. The filter element 135 can include filter material 140 that is overwrapped along the longitudinally extending surface thereof with circumscribing plug wrap material 142. In one example, the filter material 140 includes plasticized cellulose acetate tow, or other suitable cigarette-type filter material. Both ends of the filter element 135 preferably are open such that the filter material 140 contained therein is exposed at both longitudinal ends, and so as to permit the passage of aerosol therethrough in response to draw imparted on the mouth end 18 by the user.

The manner by which the tobacco roll segment 95 and the filter element segment 135 are maintained in place relative to one another longitudinally along the smoking article 10 can vary. Typically, those segments 95, 135 are secured in place through use of a longitudinally extending paper wrap or overwrap 150 that overwraps the longitudinally extending surfaces of those segments 95, 135. As such, by combining these segments 95, 135, there is provided a mouth-end segment 152.

The aerosol-generating system 92 preferably is attached to the mouth-end segment 152 using tipping material 155. Preferably, the general cross-sectional shapes and dimensions of the aerosol-generating system 92 and the mouth-end segment 152 are essentially identical to one another when viewed transversely to the longitudinal axis of the smoking article 10. Typically, those segments 92, 152 are secured in place through use of a longitudinally extending tipping material 155 that overwraps the outer longitudinally-extending surface of the mouth-end segment 152 and the adjacent downstream outer longitudinally-extending surface of the aerosol generating system 92. As such, by combining those segments 92, 152, there is provided a fully assembled, four-segment smoking article 10, according to one aspect of the disclosure.

The smoking article 10 optionally can include an air dilution provision, such as one perforation or a series of perforations 160, each of which may extend through the tipping material 155, the mouth-end segment overwrap 150 and filter plug wrap material 142 to the filter material 140. Alternatively, the various perforations 160 can extend around the smoking article 10 as a ring in a region upstream from that shown in FIG. 1.

Figure 2:
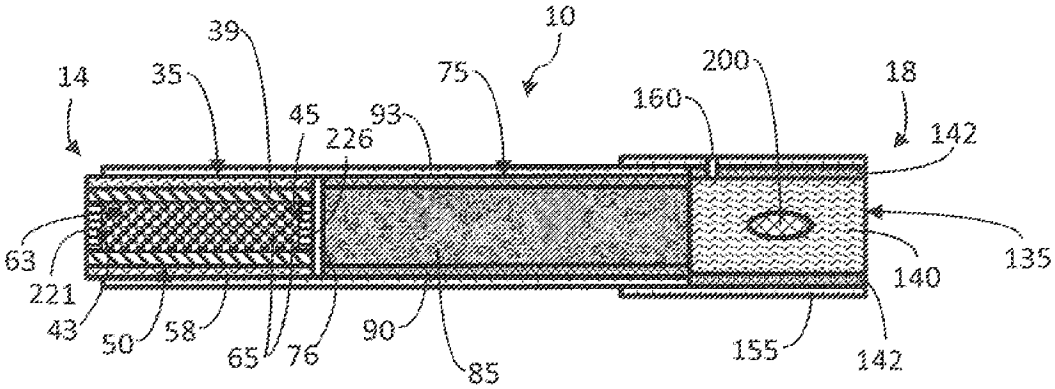

The filter element segment 135 optionally can possess one or more crushable flavor capsules 200 (see, e.g., FIG. 2). Numerous ways of handling breakable capsules and incorporating those breakable capsules into components of smoking articles and vapor delivery systems have been proposed. For example, various types of capsules suitable for use in smoking articles, smoking article components that incorporate breakable capsules, and equipment and techniques associated with manufacturing those smoking article components, are proposed in U.S. Pat. No. 6,631,722 to MacAdam et al.; U.S. Pat. No. 7,479,098 to Thomas et al.; U.S. Pat. No. 7,833,146 to Deal; U.S. Pat. No. 7,984,719 to Dube et al.; U.S. Pat. No. 7,972,254 to Stokes et al.; U.S. Pat. No. 8,186,359 to Ademe et al.; U.S. Pat. No. 8,262,550 to Barnes et al.; U.S. Pat. No. 8,308,623 to Nelson et al.; U.S. Pat. No. 8,353,810 to Garthaffner et al.; U.S. Pat. No. 8,381,947 to Garthaffner et al.; U.S. Pat. No. 8,459,272 to Karles et al.; U.S. Pat. No. 8,739,802 to Fagg; U.S. Pat. No. 8,905,243 to Dixon et al. and U.S. Pat. No. 9,055,768 to Henley et al.; US Pat. App. Pub. Nos. 2010/0184576 to Prestia et al.; 2011/0053745 to Iliev et al.; 2011/0271968 to Carpenter et al.; to Henley et al. and 2013/0085052 to Novak III, et al.; and U.S. patent application Ser. No. 14/835,962, to Ademe, filed Aug. 26, 2015; each of which are incorporated herein by reference. Additionally, representative cigarette products that possess filter elements incorporating breakable capsules have been marketed throughout the world under brand names such as "MARLBORO W-BURST 5," "KENT ISWITCH," "KOOL BOOST," "CAMEL LIGHTS WITH MENTHOL BOOST," "CAMEL CRUSH"CAMEL SILVER MENTHOL," "CAMEL FILTERS MENTHOL," and "CAMEL CRUSH BOLD."

Exemplary types of capsules, capsule ingredients, capsule configurations and formats, capsule sizes, capsule properties and capsule preparation techniques are set forth in U.S. Pat. No. 5,223,185 to Takei et al.; U.S. Pat. No. 5,387,093 to Takei; U.S. Pat. No. 5,882,680 to Suzuki et al.; U.S. Pat. No. 6,719,933 to Nakamura et al.; U.S. Pat. No. 7,754,239 to Mane; U.S. Pat. No. 6,949,256 to Fonkwe et al.; U.S. Pat. No. 7,984,719 to Dube et al.; U.S. Pat. No. 8,470,215 to Zhang and U.S. Pat. No. 8,695,609 to Dube; U.S. Pat. App. Pub. Nos. 2004/0224020 to Schoenhard; 2005/0196437 to Bednarz et al.; 2005/0249676 to Scott et al. and 2014/0053855 to Hartmann et al.; and PCT WO 03/009711 to Kim and PCT WO 2014/170947 to Iwatani; which are incorporated herein by reference. Additionally, examples of representative types of capsules and capsule components have been commercially available as "MOMINTS" by YOSHA! ENTERPRISES, INC. and "ICE BREAKERS LIQUID ICE" from THE HERSHEY COMPANY; and representative types of capsules and capsule components have been incorporated into chewing gum, such as the type of gum marketed under the tradename "CINNABURST" by CADBURY ADAMS USA.

In some aspects, the filter element segment 35 of the smoking article 10 may comprise a multi-piece filter element including, for example, an upstream segment in the form of cellulose acetate tube filter segment and downstream segment in the form of a low efficiency plasticized cellulose acetate tow segment. One skilled in the art will appreciate, however, that such multi-piece filter elements may be formed and configured in many different manner.

Various known components can be employed in association with the construction of the smoking article 10. Those components include, for example, known wrapping materials, heat conductive materials, metallic foils and foil laminates, tobacco rolls, mouth-end pieces, filter elements, plug wraps, tipping materials and adhesives. Additionally, the smoking article can incorporate any of a wide variety of known tobacco types, forms of tobacco, and blends thereof. See, for example, those representative types of components that are set forth and referenced in U.S. Pat. No. 5,183,062 to Clearman et al.; U.S. Pat. No. 5,203,355 to Clearman et al.; U.S. Pat. No. 5,588,446 to Clearman; U.S. Pat. No. 5,724,997 to Fagg et al.; U.S. Pat. No. 6,849,085 to Marton and U.S. Pat. No. 8,678,013 Crooks et al.; U.S. Pat. App. Pub. No. 2015/0157052 to Ademe et al. and U.S. patent application Ser. No. 14/840,178, filed Aug. 31, 2015 to Beeson et al.; each of which are incorporated herein by reference. Additional examples of tipping materials are described in U.S. Pat. No. 7,789,089 to Dube et al., and in U.S. Pat. App. Publ. Nos. 2007/0215167 to Crooks et al., 2010/0108081 to Joyce et al., 2010/0108084 to Norman et al., and 2013/0167849 to Ademe et al.; and PCT Pat. App. Pub. No. 2013/160671 to Dittrich et al., each of which is incorporated by reference herein. See, also, those types of materials used in constructive those types of cigarettes marketed under the trade names "Premier," "Eclipse," "Revo" and "Steam Hot One."

Suitable manners and methods for assembling representative types of smoking articles are set forth in U.S. Pat. No. 5,469,871 to Barnes et al. and U.S. Pat. No. 8,678,013 Crooks et al.; and U.S. Pat. App. Pub. Nos. 2012/0042885 to Stone et al.; 2012/0067360 to Conner et al.; 2014/0261470 to Amiss et al.; and 2015/0157052 to Ademe et al.; each of which are incorporated herein by reference.

The dimensions of the assembled rod-shaped smoking article 10 can vary. Typically, the circumference of representative smoking article ranges from about 22 mm to about 27 mm, with about 24 mm to about 25 mm in circumference being preferred. A representative smoking article has a length of between about 80 mm and about 100 mm, and the lengths of various segments incorporated within that smoking article can vary. For example, a representative smoking article can incorporate a heat generation segment 35 having a length of between about 10 mm and about 30 mm, often about 15 mm to about 20 mm; an aerosol-generating segment 75 having a length of between about 10 mm and about 40 mm, often about 20 mm to about 25 mm; a tobacco roll segment 95 having a length of between about 20 mm to about 50 mm, often about 30 mm to about 40 mm; and a filter element segment 135 having a length of between about 10 mm and about 30 mm, often about 15 mm to about 25 mm.

In use, the smoker places the mouth end 18 of the smoking article 10 in his/her lips. The smoker then lights the lighting end 14 of the smoking article 10 (e.g., using a match or cigarette lighter). That is, the lighting end of the heat source cartridge 50 is exposed to a source of heat sufficient to cause the combustible component 63 associated with the cartridge 50 to begin to burn. In some aspects, the lighting end of the heat source cartridge 50 may incorporate an element (i.e., coated with a heat sensitive paint, or incorporating a heat sensitive material) that changes color when ignited or otherwise heated by the combustion. Draw by the user upon the mouth end 18 causes atmospheric air to enter the heat generation segment 35 through upstream perforations 43. Drawn air acts to support combustion of the combustible component 63, and in addition and as a result, that drawn air is heated. Heated air is thus drawn through the cartridge 50 of the heat generation segment 35, exits the downstream perforations 45 of the cartridge 50, and enters into the aerosol-generating segment 75. Subsequently, the action of heat upon components within or associated with the aerosol-generating segment 75 results in the production of aerosol that is drawn into and through the tobacco roll segment 95. The flavored aerosol thereafter exits the tobacco roll segment 95 and flows through the filter element 135, and finally out of mouth-end region 18 of the smoking article 10 into the mouth of the smoker.

FIG. 2 illustrates a representative smoking article 10, which is similar in many regards to the smoking article described previously with reference to FIG. 1. There is shown a heat generating segment 35 and an aerosol-generating segment 75; each of which is similar in many regards to those described with reference to FIG. 1. There is shown a heat source cartridge 50 possessing a combustible component 63, which may have the form of plurality of parts or pieces 65; which parts and pieces 65 may be irregular relative to one another in terms of size and/or shape. However, rather than two components or segments (i.e., the aerosol-generating segment 75 and the tobacco roll segment 95) positioned between the heat generation segment 35 and the filter element segment 135, there is positioned a single, elongated aerosol-generating segment 75. As such, heat produced by the burning combustible component 63 within the heat generation segment 35 acts to heat the components of the single aerosol-generating segment 75 to produce an aerosol; which upon draw, flows through the filter element segment 135 and enters the mouth of the smoker.

The dimensions of the assembled rod-shaped smoking article 10 as shown in FIG. 2 can vary. Typically, the circumference of representative smoking article ranges from about 22 mm to about 27 mm, with about 24 mm to about 25 mm in circumference being preferred. A representative smoking article has a length of between about 80 mm and about 100 mm, and the lengths of various segments incorporated within that smoking article can vary. For example, a representative smoking article such as shown in FIG. 2, can incorporate a heat generation segment 35 having a length of between about 10 mm and about 30 mm, often about 15 mm to about 20 mm; an aerosol-generating segment 75 having a length of between about 20 mm and about 60 mm, often about 30 mm to about 50 mm; and a filter element segment 135 having a length of between about 10 mm and about 30 mm, often about 15 mm to about 25 mm.

Figure 3:
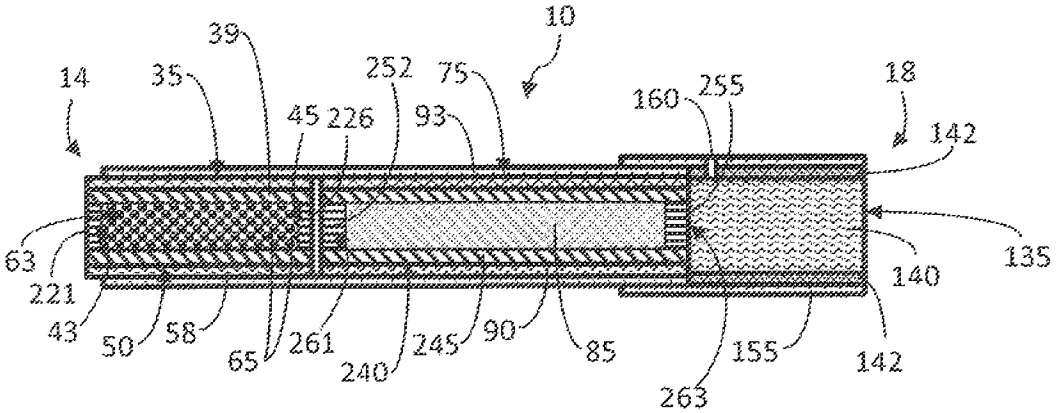

FIG. 3 illustrates a representative smoking article 10, which is similar in many regards to that smoking article described previously with reference to FIG. 1. There is shown a heat generation segment 35 constructed from a cylindrical cartridge 50 possessing a combustible component 63 that may have the form of a plurality of parts or pieces 65. Each piece of the representative combustible component 63 may have a generally spherical shape, and each piece may be nearly uniform in shape and size. These essentially-identical pieces 65 are sized and numbered so as to substantially fill the hollow internal region of the generally cylindrical cartridge 50. For example, a representative generally cylindrical cartridge 50 defining a hollow inner region having a length of about 30 mm and a diameter of about 7.5 mm can contain about 150 mg to about 650 mg of small spherical pieces or beads of combustible material (with each small bead having a diameter of about 1.3 mm).

Figure 4:
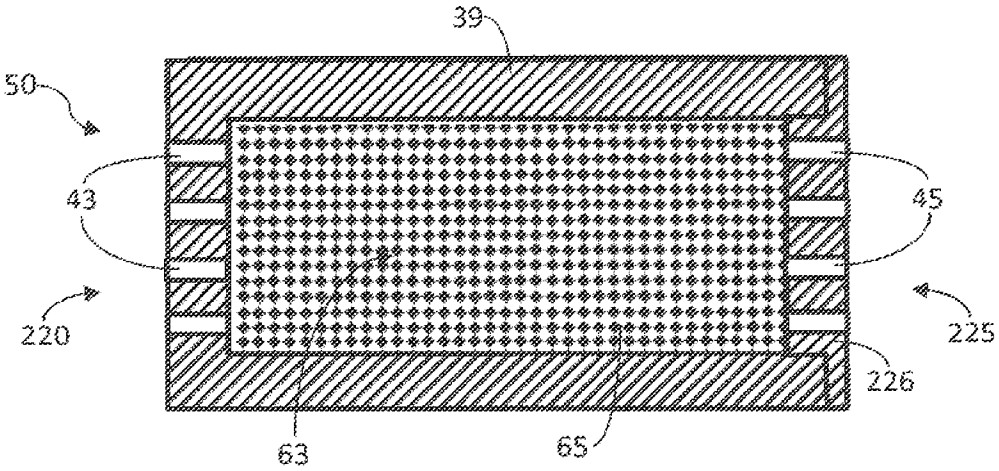

For that embodiment of the smoking article 10 shown in FIG. 3, there is shown a representative type of cartridge 50 within the heat generation segment 35 that possesses a two-piece structure, as shown more particularly in FIG. 4. The upstream end 220 of the cartridge 50 defines the extreme lighting end 14 of the cartridge 50 and includes an end wall 221 defining the upstream pores 43, with the longitudinally extending outer side wall 39 attached thereto or integrally formed therewith. As such, that upstream end 220 has the general shape of a cup or thimble. The downstream end 225 of the cartridge 50 has the form of a cap 226 defining the downstream pores 45. The cap 226 may be configured to fit inside of the downstream end 225 of the cup-shaped segment of the two-piece cartridge 50. The cap 226 can be secured in place with respect to the cup-shaped segment, for example, by a friction fit, a high temperature resistant adhesive, a weld, a suitably adapted screw fit, a suitably adapted pin and groove locking mechanism, or the like. As such, the two pieces 220, 226 that define the cartridge 50 are assembled to form a cartridge 50 that can be considered to be sealed for purposes of containing the combustible component 63 therein. For the embodiment shown in FIGS. 3 and 4, the upstream end 220 of the cartridge 50 possesses a plurality of small perforations 43 (e.g., located on the front face or upstream end wall of the cartridge 50 to form the lighting end 14 and, optionally, in the outer side wall or surface 39 of the cartridge 50 (see, e.g., FIG. 10, element 228) about the extreme upstream region thereof), so as to allow for the passage of drawn air for externally to the smoking article 10 into the cartridge 50; and the downstream end 225 of the cartridge 50 (e.g., the downstream surface defined by the cap 226) possesses a plurality of small perforations 45, so as to allow for the passage of heated air out of that cartridge 50 toward the mouth end 18.

Figure 5:
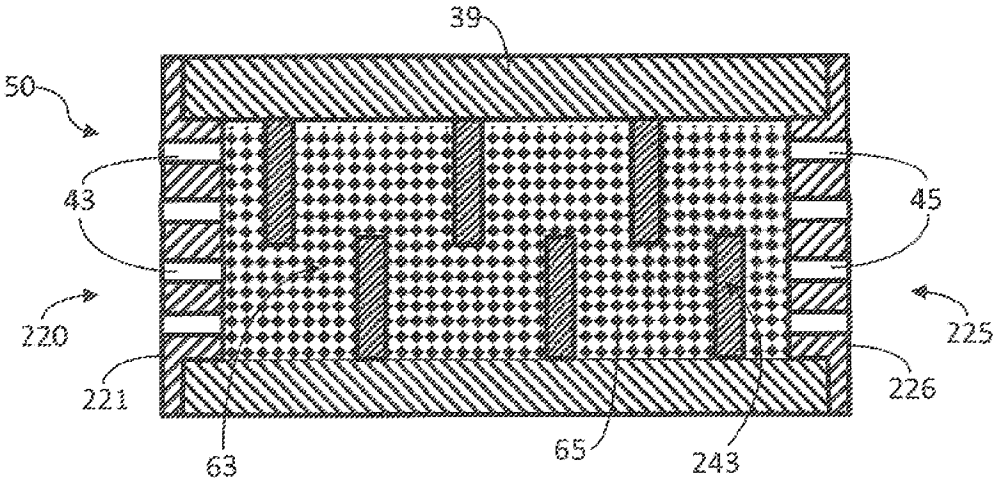

As shown in FIG. 5, one skilled in the art will appreciate that the upstream end 220 of the cartridge 50 may be configured to cooperate with the tubular portion 39 and the downstream end cap 226 to form a three-piece cartridge 50. That is, FIG. 5 illustrates that the cartridge 50 may be formed as a tubular portion 39 having an end cap 221, 226 at each end, which collectively cooperate to form the "sealed" cartridge 50. FIG. 5 also illustrates that, in some instances, the cartridge 50 may also include one or more baffles 243 extending into the compartment defined by the cartridge 50 from the side wall or tubular portion 39 thereof. Such baffles 243 (e.g., spaced partial walls essentially perpendicular to the overall path of travel of airflow through the cartridge 50) or other structures (e.g., such as a structure that defines a spiral path for travel of airflow) for providing a somewhat tortuous path of travel of airflow through the cartridge 50) may, for example, increase the effective length of the cartridge 50 through which the air is directed in response to the draw imparted by the user. Accordingly, in some instances, the length of the cartridge may be decreased while maintaining the same or similar efficacy in regard to the intended function thereof.

In accordance with the aspect illustrated in FIG. 3, the aerosol-generating segment 75 may have the form of a cartridge 240, which preferably is generally cylindrical in shape. The longitudinally-extending portion 245 of the cartridge 240 is generally tubular in nature. As such, the outer surface of the longitudinally-extending tubular portion 245 of the cartridge 240 facilitates the general rod-shaped structure of the smoking article 10; and additionally, the inner surface of the longitudinally-extending tubular portion 245 defines the inner compartment of the cartridge 240. The longitudinally-extending portion 245 preferably is essentially impermeable to the passage of atmospheric air therethrough; so that atmospheric air that is heated by the heat source cartridge 50 and exits through the downstream end 225 of the heat source cartridge 50 can pass through cartridge 240 that is part of the aerosol-generating segment 75. Typically, a cylindrical substrate cartridge 240 is provided by capping either or both of the upstream and downstream ends of longitudinally extending tubular portion with suitably adapted end caps 252, 255 (see, e.g., the exemplary cartridges shown and numbered as element 50 in FIGS. 4 and 5, with the end caps indicated by elements 221 and 226, and the longitudinally-extending tubular portion indicated by element 93). Most preferably, the end caps 252, 255 are permeable to atmospheric air, such that the heated air from the heat source cartridge 50 can pass through the upstream end cap 252, and pass through the inner compartment of the tubular portion 245 to heat the substrate material 85 located therein, and then exit the downstream end cap 255. As such, each end cap 252, 255 can be constructed using a screen-like material or may be configured so as to possess a perforation or a series of perforations 261, 263, respectively, to allow for the passage of air therethrough. As a result, the combination of the tubular portion 245 sealed at each end using the respective end caps 252, 255 thereby provides a cylindrical cartridge 240 that acts as an effective receptacle or container for a substrate 85 that carries, contains or otherwise provides a source of aerosol forming material.

For the embodiment shown in FIG. 3, the substrate or substrate material 85 may have the form of tobacco pellets. As used herein, the term "tobacco pellets" is meant to include beads, pellets, or other discrete small units of tobacco that has been formed, shaped, compressed, extruded, or otherwise fashioned into a desired shape. For example, tobacco pellets can be formed using a so-called marumarizing process. Tobacco pellets may have smooth, regular outer shapes (e.g., spheres, cylinders, ovoids, etc.) and/or they may have irregular outer shapes. In one example, the diameter of each tobacco pellet may range from less than about 1 mm to about 2 mm. The tobacco pellets may at least partially fill the compartment or substrate cavity defined by the cartridge 240, as described herein. That is, the substrate, substrate element or substrate material 85 may take the form of pellets or other loose objects that occupy a space within the cartridge 240 of the aerosol-generating segment 75 adjacent to and downstream of the heat generation segment 35. In one example, the volume of the substrate cavity defined by the cartridge 240 may range from about 500 $mm^3$ to about 700 $mm^3$ (e.g., a substrate cavity defined by a cartridge 240, wherein the cavity diameter is about 7.5 to about 7.8 mm, and the cavity length is about 11 to about 15 mm, with the cavity having a generally cylindrical geometry). In one example, the mass of the tobacco pellets within the substrate cavity may range from about 200 mg to about 500 mg. For example, the tobacco pellets can be employed so as to fill the appropriate portion of the cartridge 240 of the aerosol-generating segment 75 (e.g., the cylindrical region within the cartridge 240, with the cartridge 240 bound by the ends of the heat generation segment 35 and the filter element segment 135) at a packing density of about 100 $mg/cm^3$ to about 400 $mg/cm^3$.

Figure 6:
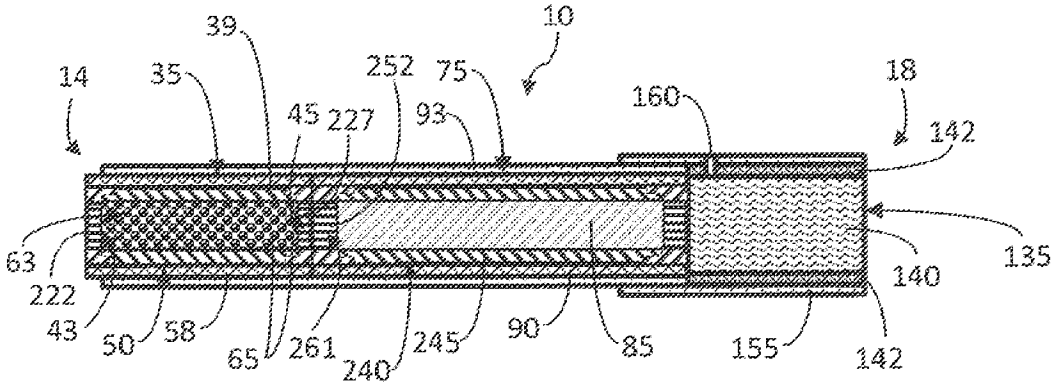

FIG. 6 illustrates a representative smoking article 10, which is similar in many regards to that smoking article described previously with reference to FIG. 1. There is shown a heat source cartridge 50 possessing a combustible component 63, which may have the form of plurality of parts or pieces 65. Each piece 65 of the representative combustible component 63 may have a generally cylindrical shape. The cylindrical pieces 65 are sized and numbered so as to substantially fill the hollow internal compartment defined by the generally cylindrical heat source cartridge 50. In some instance, the random nature of the positioning of the cylindrical pieces 65 results in voids or spaces between those pieces 65. For example, a representative generally cylindrical cartridge 50 defining a hollow inner compartment may have a length of about 30 mm and a diameter of about 7.5 mm, and can contain about 150 mg to about 650 mg small cylindrical pieces of a combustible material (with each small cylindrical piece having a length of about 1 mm and a diameter of about 1 mm).

Figure 7:
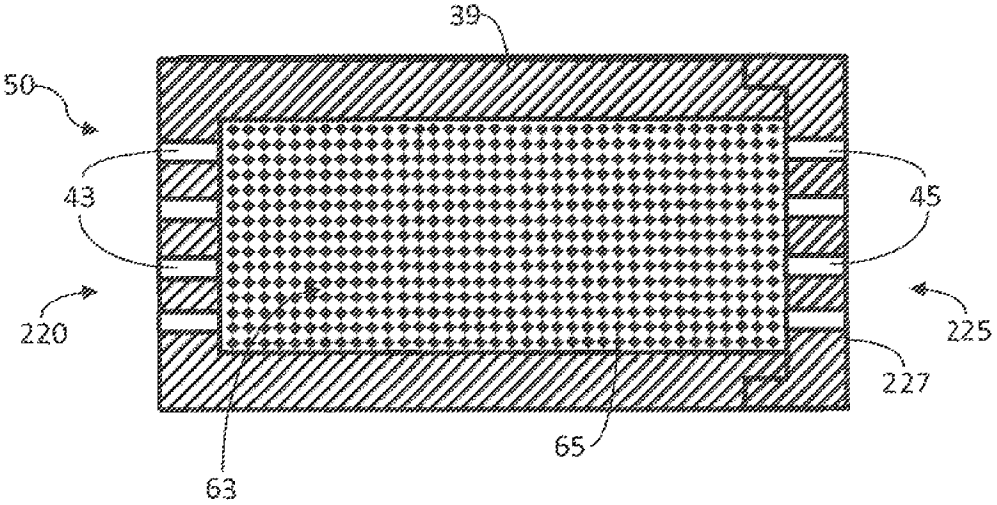

For that embodiment shown in FIGS. 6 and 7, there is shown a representative type of heat source cartridge 50 that possesses a two-piece structure. The upstream end 220 of the cartridge 50 defines the extreme lighting end 14 of the smoking article 10 and the longitudinally-extending outer side wall or tubular portion 39; and as such, that upstream end 220 has the general shape of a cup or thimble. The downstream end 225 of the cartridge 50 may have the form of a cap 227 that fits over the downstream end of the cup-shaped segment of the two-piece cartridge 50. For example, the cap 227 can be secured in place by a friction fit, a high temperature resistant adhesive, a weld, a suitably adapted screw fit, a suitably adapted pin and groove locking mechanism, or the like. As such, the two pieces 220, 227 that define the cartridge 50 may be assembled to form the cartridge 50 that can then be considered sealed for the purposes of containing the combustible component 63 therein. For the embodiment shown, the upstream end 220 of the cartridge 50 may define a perforation or a plurality of small perforations 43 (e.g., located on the front face or upstream end of the cartridge 50 and, optionally, the side face or tubular portion of the cartridge 50 (see, e.g., FIG. 10, element 228) about the extreme upstream region), so as to allow for the passage of air drawn into and through the cartridge 50). In addition, the downstream end or back face of the cartridge 50 (e.g., the back face defined by the cap 227) may define a perforation or a plurality of small perforations 45, so as to allow for the passage of heated air out of the cartridge 50 in response to the draw. For the embodiment shown, it is most preferable that the perforations 43, 45 are of small enough size, and the parts or pieces 65 of the combustible component 63 are of large enough size, so that the parts or pieces 65 of combustible component 63 are suitably contained within the cartridge 50. Additionally, the aerosol-generating segment 75 may include an implement a cartridge 240 that is similar in many regards to that cartridge 50 used for the construction of the heat generation segment 35.

Figure 8:
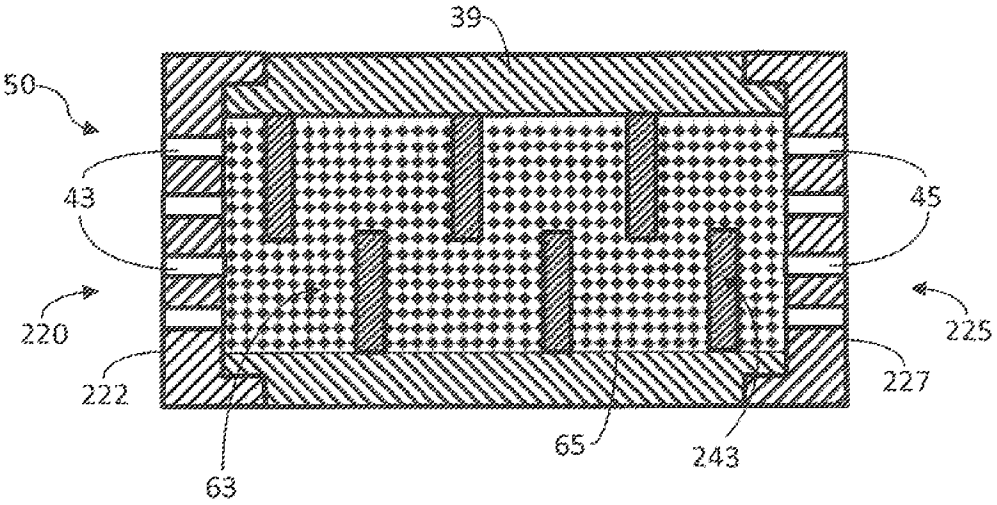

As shown in FIG. 8, one skilled in the art will appreciate that the upstream end 220 of the cartridge 50 may be configured to cooperate with the tubular portion 39 and the downstream end cap 227 to form a three-piece cartridge 50. That is, FIG. 8 illustrates that the cartridge 50 may be formed as a tubular portion 39 having an end cap 222, 227 at each end, which collectively cooperate to form the "sealed" cartridge 50. Each of the upstream and downstream end caps 222, 227 may be configured to fit over the respective upstream and downstream ends of the tubular portion 39 to form the cartridge 50. For example, each of the end caps 222, 227 can be secured in place with the tubular portion 39 by a friction fit, a high temperature resistant adhesive, a weld, a suitably adapted screw fit, a suitably adapted pin and groove locking mechanism, or the like. As such, the three pieces 39, 222, 227 that define the cartridge 50 may be assembled to form the cartridge 50 that can then be considered sealed for the purposes of containing the combustible component 63 therein. FIG. 8 also illustrates that, in some instances, the cartridge 50 may also include one or more baffles 243 extending into the compartment defined by the cartridge 50 from the side wall or tubular portion 39 thereof. Such baffles 243 (e.g., spaced partial walls essentially perpendicular to the overall path of travel of airflow through the cartridge 50) or other structures (e.g., such as a structure that defines a spiral path for travel of airflow) for providing a somewhat tortuous path of travel of airflow through the cartridge 50) may, for example, increase the effective length of the cartridge 50 through which the air is directed in response to the draw imparted by the user.

Figure 9:
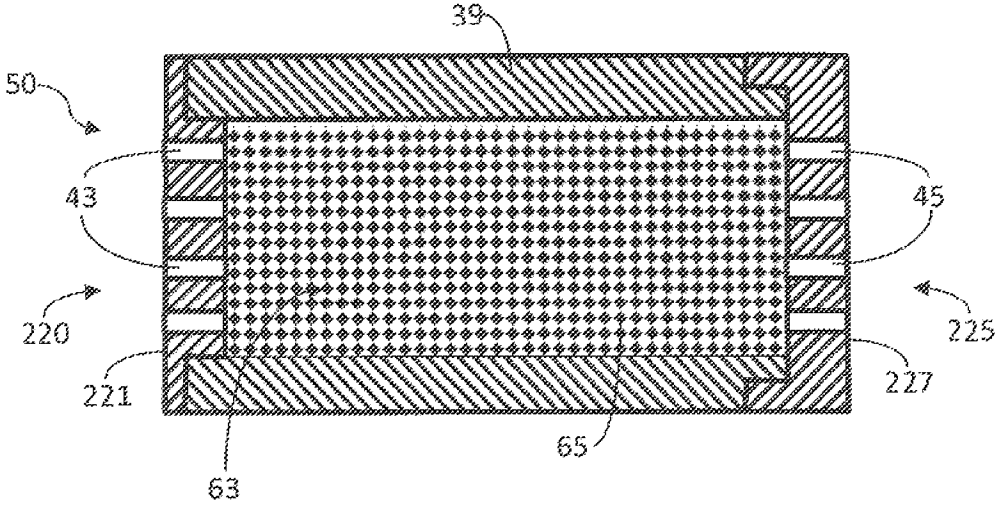
Figure 10:
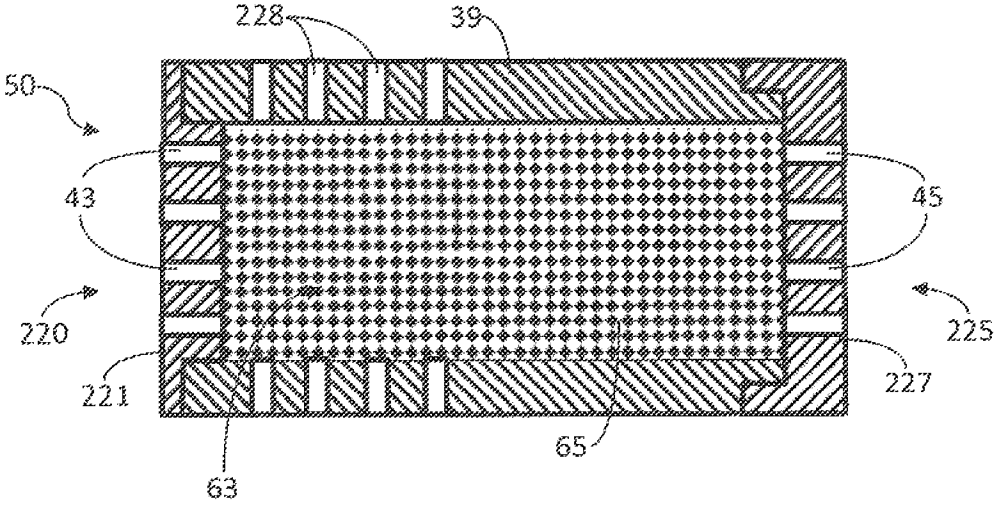

FIGS. 9 and 10 illustrate other exemplary aspects and configurations of a cartridge 50, 240 that can be implemented in various configurations of the types of smoking articles disclosed herein. For example, FIG. 9 illustrates one configuration of a three-piece cartridge 50 wherein one of the end caps 221 may be configured to fit inside of the upstream end 220 of the tubular portion 39, and wherein the other end cap 227 is configured to fit over the downstream end 225 of the tubular portion 39. Either cap 221, 227 can be secured in place with respect to the tubular body 39, for example, by a friction fit, a high temperature resistant adhesive, a weld, a suitably adapted screw fit, a suitably adapted pin and groove locking mechanism, or the like. The embodiment of the cartridge 50 shown in FIG. 10 is similar to the cartridge configuration shown in FIG. 9, but additionally include one or more pores or perforations 228 defined by the tubular portion 39 of the cartridge 50. In particular instances, the pores 228 may be disposed toward the extreme lighting end 14 in instances where the cartridge 50 is included in the heat generation portion or segment 35. In such instances, the increased number of pores or perforations may facilitate ignition of the combustible component 63 within the cartridge 50, as well as, for example, increased air flow into the heat generation cartridge 50 is response to the draw, or less resistance to draw. In other instances, the pores 228 defined by the tubular member 39 may provide a cooling air flow about the outer surface of the tubular member 39, which may, for instance, reduce, minimize, or eliminate scorching of the paper wrap or overwrap 93 during use of the smoking article 10.

Figure 11:
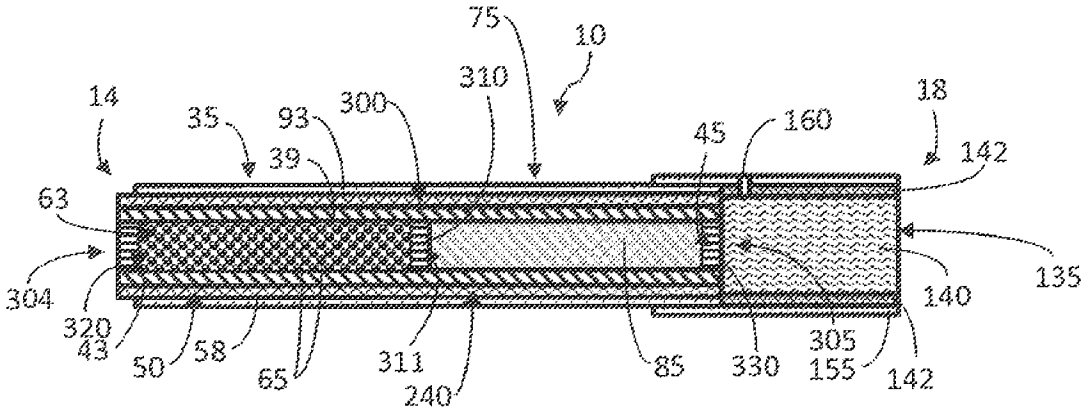

FIG. 11 illustrates another representative smoking article 10 that possesses an elongated integral dual cartridge 300 that provides both a heat source cartridge portion 50 and a cartridge portion 240 for containing substrate material 85 used to carry components employed for aerosol formation. The heat source cartridge portion 50 (i.e., the portion of the dual cartridge 300 containing the combustible component 63, wherein the combustible component 63 may comprise, for example, a plurality of granules of combustible carbonaceous material) is located about the upstream end of the dual cartridge 300 (i.e., toward the lighting end 14), and the container portion 240 for the substrate material 85 that provide or carry aerosol forming material (e.g., a plurality of beads formed from a mixture of pulverized tobacco dust and glycerin) is located at the downstream end of the dual cartridge 300 (i.e., toward the filter element segment 135). Between the upstream and downstream cartridge portions 50, 240 is positioned an air permeable barrier 310 (e.g., a screen) that physically separates the components of the cartridge from one another. That is, the heat generation cartridge may be configured as a right cylinder or a fluted cylinder, having a longitudinally-extending side wall 39, the opposed end portions 304, 305, and a medial divider 310 disposed within the side wall 39 between the opposed ends 304, 305, wherein the side wall 39 cooperates with the medial divider 310 and the ends portions 304, 305 to define serially-disposed first and second compartments 50, 240, with the first compartment 50 being configured to receive the fuel element/combustible component 63, and the second compartment 240 being configured to receive the aerosol generation element 85 (and thus forming the aerosol-generating portion 75). The barrier 310 may define one or more pores or perforations 311 to allow for the passage of heated air from the upstream cartridge portion 50 into the downstream cartridge 240 for the heated air to interact with the aerosol generating element 85 to produce the aerosol. The extreme upstream end 304 of the cartridge 300 may be sealed with a perforated cap 320 defining one or more pores or perforations 43, thus providing for maintenance of the combustible component 63, or granules thereof, within that portion 50 of the dual cartridge 300. The extreme downstream end 305 of the dual cartridge 300 may be sealed with a perforated cap 330 defining one or more pores or perforations 45, thus providing for maintenance of the substrate material 85 within that portion 240 of the dual cartridge 300. Typically, such a dual cartridge 300 is constructed of components comprised of an insulating material, such as carbon (graphite), glass, or ceramic. In optional instances, a heat conductive material, such as aluminum or stainless steel, may be used. Optionally, the length of such a dual cartridge 300 can be wrapped, surrounded, covered, or overcoated with a thermal insulator 58 (e.g., a material composed of ceramic insulator, glass fiber mat, or the like).

For the embodiment shown in FIG. 11, either or both of the cartridge portions 50, 240 can incorporate, for example, capsules that release components suitable for modification of the aerosol formed during use of the smoking article 10. For example, capsules that release their contents upon being subjected to the action of heat experienced during use of the smoking article 10 can provide a source of aerosol components and/or act to modify the sensory attributes of the aerosol. Exemplary types of capsules suitable as optional filter element components have been described previously with reference to FIG. 2.

One skilled in the art will appreciate that the cartridge 50, 240 may be configured in many different manners in accordance with the disclosure herein. For example, as shown in FIG. 12, the cartridge 50 may be generally of the type disclosed in FIG. 7. More particularly, the upstream end 220 of the cartridge 50 may define the extreme lighting end 14 of the cartridge 50 and includes an end wall 314 defining the upstream pores 43, with the longitudinally extending outer side wall 39 attached thereto or integrally formed therewith. As such, that upstream end 220 has the general shape of a cup or thimble, with a flange 313 extending about the circumference of the outer side wall 39 about the lighting end 14. The downstream end 225 of the cartridge 50 has the form of a cap 315 defining the downstream pores 45. The cap 315 may be configured to fit over the downstream end 225 of the cup-shaped segment of the cartridge 50. The cap 315 can be secured in place with respect to the cup-shaped segment, for example, by a friction fit, a high temperature resistant adhesive, a weld, a suitably adapted screw fit, a suitably adapted pin and groove locking mechanism, or the like. The cap 315 may further include a flange 318 extending about the circumference thereof, outwardly of the portion extending over the cup-shaped segment of the cartridge 50. A sleeve member 316 may be configured to be installed over the tubular body 39, for example, by having an inner diameter larger than the outer diameter of the tubular body 39, such that one end 316A of the sleeve member 316 interacts with the lighting end flange 313, while the opposing end 316B extends about the flange 318 associated with the cap 315. In this manner, the flange 318 associated with the cap 315 may serve to coaxially align the sleeve member 316 with the tubular body 39, so as to define an annular cylindrical space 317 therebetween. The annular cylindrical space 317, being occupied, for example, by air or other suitable insulating material, may allow heat to be radially contained and thus, for instance, may reduce, minimize, or eliminate the risk of scorching of the paper wrap or overwrap 93. That is, in some aspects, the heat generation cartridge 50 may include a first portion 39, 314 (collectively) defining an inner compartment configured to receive the fuel element/combustible component 63, and a second portion 315, 316 (collectively) including an outer sleeve 316 configured to be coaxially disposed with respect to and surrounding the first portion 39, with the outer sleeve 316 being radially spaced apart from first portion 39 defining the inner compartment and cooperating therewith to define an annulus 317 therebetween. FIG. 13 illustrates an alternative configuration of the cartridge 50 shown in FIG. 12, but wherein the sleeve member 316 and the cap 315 are formed as a single integral member.

FIG. 12 further illustrates that the heat source cartridge 50 may be configured to receive a multi-component combustible component 63. That is, in some instances, one portion 65 of the combustible component 63 has the form of unitary piece; and the other portion 66 of the combustible component 63 has the general form of a tube, cup, or coating positioned along the inner surface of the tubular portion 39. For example, a liquid or a moist paste of a combustible component material and/or an ignition aide can be coated onto the inner surface of the tubular portion 39 and dried, or a formed tube or cup of a combustible component material can be fabricated and positioned within the tubular portion 39 so that the outer surface of the formed tube 66 contacts the inner surface of the tubular portion 39.

Example

A representative smoking article 10 may be of the type as shown in FIG. 1. The heat generating segment thereof may include a cartridge having the shape of a cylinder. The cartridge may be a two-piece cartridge; with the larger upstream piece generally having the form of a cup, and the smaller downstream piece having the form of an end cap that fits over the open end of the upstream piece. The pieces of the cartridge are comprised of graphite, and are formed by machining a solid graphite block. The cartridge exhibits insulative thermal properties.

The larger upstream piece of the cartridge has a diameter of about 8 mm, and a longitudinally extending length of about 11 mm; and the side and end walls of that piece each have thicknesses of about 1 mm. The extreme upstream face of the larger piece defines a series of 21 small, circularly-shaped passageways extending therethrough, with each passageway having a diameter of about 0.5 mm. Those 21 passageways are spaced in a regular 3-5-5-5-3 arrangement. The longitudinally extending face of the larger piece defines a series of 90 small, circularly-shaped passageways extending therethrough; with each passageway having a diameter of about 0.5 mm. Those 90 passageways are arranged in 10 equally spaced rows of perforations, with each row possessing 9 equally spaced perforations extending in a straight line from the upstream end to the downstream end of the end wall.

The smaller piece or end cap has a downstream diameter of about 8 mm and an upstream diameter of about 6 mm. The total longitudinally extending length of the smaller piece is about 2 mm. The downstream face of the smaller piece defines a series of 21 small, circularly-shaped passageways extending therethrough; with each passageway having a diameter of about 0.5 mm. Those 21 passageways are spaced in a regular 3-5-5-5-3 arrangement. The upstream region of the end cap is inserted into the open end of the larger piece (and is held in place by friction fit), and the downstream region of the end cap covers the extreme downstream end of the larger piece. As such, there is provided a sealed cylinder defining 132 small perforations and having an overall length of about 12 mm.

The inner hollow region of the cylinder so provided has a volume about 0.28 cc. In that hollow region is located about 100 to about 200 of ground pieces produced from the fuel element material used as the fuel element for a "Revo" cigarette product, manufactured commercially by R. J. Reynolds Tobacco Company, which functions as the combustible component.

FIG. 14 schematically illustrates a method of forming an elongate smoking article having a lighting end and an opposed mouth end. Such a method may comprise wrapping an outer wrapping material at least about a heat generation portion disposed about the lighting end, such that the outer wrapping material extends toward a mouth end portion disposed about the mouth end, and so as to define a cylindrical rod (Block 400). An aerosol-generating portion is disposed within the outer wrapping material, between the heat generation portion and the mouth end portion, with the aerosol-generating portion being configured to generate an aerosol in response to heat received from the heat generation portion (Block 410). A heat generation cartridge is disposed within the heat generation portion such that the heat generation cartridge is at least partially exposed at the lighting end, with the heat generation cartridge being configured to include opposed perforated end portions and an ignitable fuel element between the end portions, such that the fuel element is capable of emitting heat upon ignition thereof (Block 420). Other aspects and/or steps of such a method of forming a smoking article are otherwise disclosed in connection with the disclosure of the various embodiments and aspects of a smoking article otherwise addressed herein.

Aspects of the present disclosure, particularly aspects involving a heat generation cartridge, may thus provide certain benefits and improvements to the types of smoking articles disclosed herein. For example, aspects involving a heat generation cartridge may prevent "fall off" of portions of the combustible component that are consumed by the combustion thereof (i.e., ash), since any such consumed portions are contained within the cartridge itself. Further, since the cartridge involves a structure that is preferably not consumed by combustion, aspects involving such a cartridge may provide that the heat generation portion securely retains the cartridge during use of the smoking article (i.e., since the cartridge is not consumed, it may be more securely retained within the smoking article, as compared to a "conventional" combustible component that may decrease in diameter and be at higher risk of falling out of the smoking article during use). Still further, aspects involving a heat generation cartridge may serve to contain any sparks which may be emitted by the combustible component once ignited.

In light of possible interrelationships between aspects of the present disclosure in providing the noted benefits and advantages associated therewith, the present disclosure thus particularly and expressly includes, without limitation, embodiments representing various combinations of the disclosed aspects. Thus, the present disclosure includes any combination of two, three, four, or more features or elements set forth in this disclosure, regardless of whether such features or elements are expressly combined or otherwise recited in the description of a specific embodiment herein. This disclosure is intended to be read holistically such that any separable features or elements of the disclosure, in any of its aspects and embodiments, should be viewed as intended, namely to be combinable, unless the context of the disclosure clearly dictates otherwise.

Many modifications and other aspects of the disclosures set forth herein will come to mind to one skilled in the art to which these disclosures pertain having the benefit of the teachings presented in the foregoing descriptions and the associated drawings. For example, those of skill in the art will appreciate that embodiments not expressly illustrated herein may be practiced within the scope of the present disclosure, including that features described herein for different embodiments may be combined with each other and/or with currently-known or future-developed technologies while remaining within the scope of the claims presented here. Therefore, it is to be understood that the disclosures are not to be limited to the specific aspects disclosed and that equivalents, modifications, and other aspects are intended to be included within the scope of the appended claims. Although specific terms are employed herein, they are used in a generic and descriptive sense only and not for purposes of limitation.

That which is claimed:

1. A cartridge for a smoking article comprising:

a longitudinally-extending housing defining a first end portion and a second end portion, a cavity being defined within the longitudinally-extending housing between the first end portion and the second end portion;

an aerosol-generating material disposed within the cavity and being configured to generate an aerosol in response to heat; and a combustible component comprising a plurality of objects disposed within a compartment defined within the cavity between the aerosol-generating material and the first end portion, the combustible component forming an ignitable fuel element, the ignitable fuel element being capable of emitting the heat upon ignition thereof, wherein the compartment comprises one or more baffles extending into the compartment from a sidewall thereof to about a centerline of the compartment.

2. The cartridge of claim 1, wherein the plurality of objects comprises irregularly-shaped objects sized and numbered so as to substantially fill the compartment and positioned to define a plurality of voids therebetween.

3. The cartridge of claim 1, wherein the plurality of objects comprises generally cylindrically-shaped objects sized and numbered so as to substantially fill the compartment and positioned to define a plurality of voids therebetween.

4. The cartridge of claim 1, wherein at least one of the first end portion or the second end portion of the longitudinally-extending housing comprises an end cap having one or more perforations defined therein.

5. The cartridge of claim 1, wherein the longitudinally-extending housing defines one or more perforations extending circumferentially around at least a portion of the longitudinally-extending housing downstream of the ignitable fuel element.

6. The cartridge of claim 1, wherein the longitudinally-extending housing comprises graphite, carbon fiber-reinforced carbon, ceramic, fibrous refractory composite insulation, aluminum, aluminum oxide, or silicon dioxide.

7. The cartridge of claim 1, wherein the plurality of objects forming the ignitable fuel element comprises a mixture of a combustible carbonaceous material and a tobacco material.

8. The cartridge of claim 1, wherein the plurality of objects forming the ignitable fuel element comprises a mixture of a combustible carbonaceous material and a non-combustible material.

9. The cartridge of claim 1, wherein the plurality of objects comprises a mixture of one or more of flakes, spheres, cylinders, tubes, rings, cubes, shredded pieces of sheet-like material, helical strands, long string-like or tape-like strands, or irregular pieces.

10. The cartridge of claim 1, wherein the aerosol-generating material comprises tobacco pellets, tobacco shreds, tobacco beads, or a combination thereof.

11. The cartridge of claim 1, wherein the compartment is disposed between the first end portion and the aerosol-generating material so that the compartment and the aerosol-generating material are arranged in serial alignment within the cavity.

12. The cartridge of claim 11, wherein a region is formed within the cavity between the compartment containing the plurality of objects and the aerosol-generating material, wherein the region between the compartment containing the plurality of objects and the aerosol-generating material comprises an air permeable material.

13. The cartridge of claim 12, wherein the air permeable material comprises a metal, a ceramic material, or a combination thereof.

14. The cartridge of claim 11, wherein the compartment containing the plurality of objects comprises opposed perforated end portions and a longitudinally extending portion positioned between the opposed perforated end portions.

15. The cartridge of claim 14, wherein the compartment containing the plurality of objects is received within the cavity of the longitudinally-extending housing such that the first end portion of the longitudinally-extending housing and one of the opposed perforated end portions of the compartment are substantially co-planar.

16. The cartridge of claim 14, wherein the compartment containing the plurality of objects is partially received with the cavity of the longitudinally-extending housing such that one of the opposed perforated end portions and a portion of the longitudinally-extending portion of the compartment are external to the first end portion of the longitudinally-extending housing.

17. The cartridge of claim 1, wherein the longitudinally-extending housing defines a tubular or fluted cross-section.

18. The cartridge of claim 1, further comprising an insulation element wrapped about and extending longitudinally along the longitudinally-extending housing from the first end portion to the second portion thereof.

19. The cartridge of claim 18, wherein the insulating element comprises a glass fiber mat, an insulating coating, an insulating paint, a glass sleeve, or a ceramic sleeve.

20. The cartridge of claim 1, wherein the combustible component is coated on or formed as a portion of the cartridge.

21. The cartridge of claim 1, wherein the combustible component is constructed as a unitary member.

* * * * *